US005786800A

United States Patent [19]

Gyouten

[11] Patent Number: 5,786,800

[45] Date of Patent: Jul. 28, 1998

[54] DISPLAY DEVICE

[75] Inventor: Seijirou Gyouten, Tenri, Japan

[73] Assignee: Sharp Kabushiki Kaisha, Osaka, Japan

[21] Appl. No.: 630,973

[22] Filed: Apr. 12, 1996

[30] Foreign Application Priority Data

Apr. 14, 1995 [JP] Japan ..... 7-089860

[51] Int. Cl.[6] ..... G09G 3/36

[52] U.S. Cl. ..... 345/98; 345/99

[58] Field of Search ..... 345/98, 99, 87, 345/90, 89, 196, 197, 204, 208

[56] References Cited

U.S. PATENT DOCUMENTS 5,359,343 10/1994 Nakamura ..... 345/98
5,414,443 5/1995 Kanatani et al. ..... 345/89
5,523,772 6/1996 Lee ..... 345/98
5,523,773 6/1996 Arakawa et al. ..... 345/98
5,623,278 4/1997 Okada et al. ..... 345/99
5,646,644 7/1997 Furuhashi et al. ..... 345/87

*Primary Examiner*—Steven Saras
*Assistant Examiner*—Xu-Ming Wu

[57] ABSTRACT

The data signals retained in the data latch circuit are captured securely in the line latch circuit. The data latch control circuit sequentially creates data latch control signals DLC having timing values shifted from one another by one period of a data latch clock signal DLCK. The first n-bit display data DA is retained in the D latch circuits at the first stage of the data latch circuit in accordance with the first signal DLC and then retained in the D latch circuits at the second stage in accordance with the second signal DLC. Furthermore, the second display data DA is retained in the D latch circuits of the data latch circuit. The display data DA for one scanning electrode is retained in the line latch circuit by a capture signal LPS delivered between the termination of the delivery of a horizontal synchronizing signal LP and the termination of the delivery of the first signal DLCK to the next scanning electrode.

12 Claims, 24 Drawing Sheets

DISPLAY DEVICE

BACKGROUND OF THE INVENTION

1. Field of the Invention

The present invention relates to a display device of simple matrix drive type, such as a liquid crystal display device, and more particularly to a display device having a segment-side drive circuit capable of securely retaining display data for one scanning electrode even when high-speed drive is performed, and thus capable of offering excellent display quality.

2. Description of the Related Art

FIG. 19 is a block diagram showing the electrical configuration of a liquid crystal display device 117 having a segment-side drive circuit 102 in accordance with a conventional embodiment. The liquid crystal display device 117 comprises a liquid crystal panel 101, a segment-side drive circuit 102, a common-side drive circuit 103, a power supply circuit 104 and a control circuit 105.

The liquid crystal panel 101 is formed by disposing a liquid crystal between a pair of substrate members. When the liquid crystal panel 101 is a transmission panel, for example, one of the pair of substrate members has an insulating transparent substrate and stripe-shaped segment electrodes X1 to Xi ($i \geqq 1$) arranged on the transparent substrate at intervals in parallel with each other. In addition, the other substrate member has an insulating transparent substrate and stripe-shaped scanning electrodes Y1 to Yj ($j \geqq 1$) arranged on the transparent substrate at intervals in parallel with each other. Furthermore, the one and the other substrate members have liquid crystal orientation films covering the arranged electrodes X1 to Xi and Y1 to Yj. The liquid crystal panel 101 uses the intersections of the segment electrodes X1 to Xi and the scanning electrodes Y1 to Yj as pixels and performs display by combining a plurality ($i \times j$) of pixels.

From the control circuit 105, display data DA, a data latch clock signal DLCK, a horizontal synchronizing signal LP and an alternating signal are supplied to the segment-side drive circuit 102 via signal lines 106, 107, 108 and 109, respectively. In addition, a vertical synchronizing signal is supplied to the common-side drive circuit 103 via a signal line 110. The horizontal synchronizing signal LP is also supplied to the common-side drive circuit 103.

From the power supply circuit 104, power voltage signals V0 to V5 having six different voltages are outputted to power voltage lines 111 to 116. The power voltage signals V0, V2, V3 and V5 are supplied to the segment-side drive circuit 102, and the power voltage signals V0, V1, V4 and V5 are supplied to the common-side drive circuit 103.

FIG. 20 is a timing chart showing signals supplied to the liquid crystal panel 101. The following explanation is given by paying attention to the electrodes X1 and Y1. The segment output voltage signal VX (V0, V2, V3, V5) shown in FIG. 20 is supplied to the segment electrode X1 to perform display on the basis of the display data DA shown in FIG. 20. More specifically, signal V5 is supplied during the period between the fall of the horizontal synchronizing signal LP shown in FIG. 20 and the fall of the next horizontal synchronizing signal LP, signal V5 is also supplied during the period between the next horizontal synchronizing signal LP and the further next horizontal synchronizing signal LP, and signal V3 is supplied during the period between the further next horizontal synchronizing signal LP and the yet further horizontal synchronizing signal LP. Thereafter, signal V5 is supplied when the display data DA is on, and signal V3 is supplied when the display data DA is off, in which the number of signal supplying times corresponds to the number (j) of the scanning electrodes. The period during which the horizontal synchronizing signal LP is delivered j times (j: the number of the scanning electrodes) corresponds to one vertical synchronizing period. During the next vertical synchronizing period, the signal level of the alternating signal shown in FIG. 20 is switched. When the signal level of the alternating signal is switched, the signal level of the segment output voltage signal is changed. When the display data DA is on, signal V0 is supplied, and when the display data DA is off, signal V2 is supplied.

To the scanning electrode Y1, the common output voltage signal VY (V0, V1, V4, V5) shown in FIG. 20 is supplied. More specifically, signal V0 is supplied during the period between the fall of the horizontal synchronizing signal LP shown in FIG. 20 and the fall of the next horizontal synchronizing signal LP, and signal V4 is supplied during the period between the next horizontal synchronizing signal LP and the further next horizontal synchronizing signal LP. During the next period following the period during which signal V0 is supplied to the scanning electrode Y1, signal V0 is supplied to the scanning electrode Y2 adjacent to the scanning electrode Y1. Thereafter, signal V0 is supplied to the scanning electrodes Y3, Y4, . . . , Yj in this sequence in the same way, and the electrodes Y1 to Yj are selected in this sequence, respectively. Signal V0 is supplied to electrodes selected from the scanning electrodes Y1 to Yj, and signal V4 is supplied to the non-selected electrodes of the scanning electrodes Y1 to Yj. During the next vertical synchronizing period, signal V5 is supplied to electrodes selected from the scanning electrodes Y1 to Yj, and signal V1 is supplied to the non-selected scanning electrodes Y1 to Yj.

By supplying signals in this way, voltages are applied to the liquid crystal panel 101 as shown in FIG. 20. The voltages are those applied to the intersection of the electrodes X1 and Y1. Voltage (V0–V5) is applied during the period between the fall of the horizontal synchronizing signal LP and the fall of the next horizontal synchronizing signal LP, voltage (V4–V5) is applied during the period between the next horizontal synchronizing signal LP and the further next horizontal synchronizing signal LP, and voltage (V4–V3) is applied during the period between the further next horizontal synchronizing signal LP and the yet further next horizontal synchronizing signal LP. During the next vertical synchronizing period, voltage (V5–V0) is applied during the period between the fall of the horizontal synchronizing signal LP and the fall of the next horizontal synchronizing signal LP, voltage (V1–V0) is applied during the period between the next horizontal synchronizing signal LP and the further next horizontal synchronizing signal LP, and voltage (V1–V2) is applied during the period between the further next horizontal synchronizing signal LP and the yet further next horizontal synchronizing signal LP. In this way, the logic level of the voltage is inverted each time the vertical synchronizing signal is delivered.

FIG. 21 is a block diagram showing the configuration of the segment-side drive circuit 102. The control circuit 105 delivers display data for one scanning electrode n bits at a time and by performing the delivery m/n times, it completes the delivery of the display data for one scanning electrode. However, this corresponds to a case wherein a single drive circuit having m outputs is used as the segment-side drive circuit 102. A plurality of such circuits may be used. In the liquid crystal display device 117, the total i of the segment electrodes is an integer multiple of n, that is, m=i.

The segment-side drive circuit 102 comprises a data latch control circuit 121, a data latch circuit 122, a line latch circuit 123, a level shifter circuit 124 and a liquid crystal drive output circuit 125. To drive the segment-side drive circuit 102, power voltage Vcc and ground potential GND are provided.

To the data latch control circuit 121, the n-bit display data DA, the data latch clock signal DLCK and the horizontal synchronizing signal LP are supplied. In the data latch control circuit 121, a data latch control signal DLC is created on the basis of the data latch clock signal DLCK, and supplied to the data latch circuit 122. The data latch control circuit 121 is connected to the data latch circuit 122 via a n-bit bus line 126. The display data DA supplied to the data latch control circuit 121 is stored in the data latch circuit 122.

When the display data DA for one scanning electrode is stored in the data latch circuit 122, the display data DA is supplied to the line latch circuit 123 and further to the level shifter 124. The display data DA for one scanning electrode stored in the data latch circuit 122 is captured in the line latch circuit 123 on the basis of a capture signal LPS inverted by an inverter 127. To the liquid crystal drive output circuit 125, four different power voltage signals V0, V2, V3 and V5 are supplied. One of the voltage signals is selected for one segment electrode and the voltage signal is applied to the segment electrodes X1 to Xi in parallel.

FIG. 22 is a circuit diagram showing the configuration of the data latch circuit 122 and the line latch circuit 123. The data latch circuit 122 comprises m pieces of D flip-flop (hereinafter referred to as "DFF") circuits 128 arranged in parallel. The n-bit bus line 126 for connecting the data latch control circuit 121 to the data latch circuit 122 comprises n pieces of lines. The n pieces of lines are sequentially connected to each of D terminals of m pieces of DFF circuits 128 of the data latch circuit 122. m/n pieces of the data latch control signals DLC created on the basis of the data latch clock signal DLCK by the data latch control circuit 121 is supplied to the data latch circuit 122 via data latch control signal line 130. The data latch control signal line 130 comprises m/n pieces of lines and the lines are sequentially connected to each of CK terminals of m pieces of DFF circuits 128 of the data latch circuit 122 so that each line corresponds to a n-bit DFF circuit 128.

The output signal from each of the Q terminals of m pieces of DFF circuits 128 is supplied to each of the D terminals of m pieces of DFF circuits 129 constituting the line latch circuit 123. The DFF circuits 129 are arranged in parallel. The capture signal LPS obtained by inverting the horizontal synchronizing signal LP by the inverter 127 is inputted to each of the CK terminals of m pieces of DFF circuits 129 of the line latch circuit 123. The output signal from each of the Q terminals of the plural DFF circuits 129 is supplied to the level shifter 124.

FIGS. 23A and 23B are circuit diagrams showing the configuration of the DFF circuits 128 and 129. Each of the DFF circuits 128 and 129 comprises clocked inverters 131, 133, 134 and 136, and inverters 132, 135 and 137. The input signal to the CK terminal is partially inverted by the inverter 137 to deliver a signal CKAN, and a noninverted signal CKA as shown in FIG. 23B. The input signal from the D terminal is delivered from the Q terminal via the clocked inverters 131, 133, 134 and 136, and the inverters 132 and 135.

FIG. 24 is a circuit diagram of a clocked inverter. In the clocked inverter, while an input signal A is "H"-high, the input signal to the D terminal is inverted and delivered from the Q terminal as an inverted signal. On the other hand, while the input signal A is "L"-low, the output signal from the Q terminal is in a high impedance condition (OPEN condition), regardless of the level of the input signal to the D terminal.

Referring to FIGS. 23A and 23B, when signal CKA is "H", the input signal to the D terminal passes through the clocked inverter 133, the inverter 132, the clocked inverter 134 and the inverter 135 in this sequence and is outputted from the Q terminal. The clocked inverters 131, 136 are off and data is stored between the clocked inverter 133 and the inverter 132. More specifically, with the output signal from the Q terminal not affected by the input signal to the D terminal, a signal, the level of which is as high as that of the input signal to the D terminal at the rise of signal CKA, is outputted from the Q terminal, and the level of the output signal is retained until the rise of the next signal CKA.

On the other hand, when signal CKA is "L", the input signal passes through the clocked inverter 136 and the inverter 135 and then is outputted. The clocked inverter 133 and the inverter 134 are off and data is retained between the clocked inverter 136 and the inverter 135. More specifically, the input signal to the D terminal at the fall of signal CKA is retained and outputted from the Q terminal.

FIG. 25 is a timing chart showing the operations of the circuits 121 to 123 of the segment-side drive circuit 102. By supplying the data latch clock signal DLCK shown in FIG. 25 to the data latch control circuit 121, the data latch control signals DLC (m/n−1), DLC (m/n) and DLC1, having timing values shifted from one another by one period of the clock signal as shown in FIG. 25, are created. Each data latch control signal DLC is supplied to the CK terminals of the DFF circuits 128 of the data latch circuit 122. The data latch control signal DLC is created by a shift register included in the data latch control circuit 121. The DFF circuits 128 capture the display data DA at the falling timing of the data latch control signal DLC, outputs the display data DA at the rising timing and supply the display data DA to the DFF circuits 129 of the line latch circuit 123.

When the horizontal synchronizing signal LP shown in FIG. 25 is delivered from the control circuit 105, the capture signal LPS shown in FIG. 25 is supplied to the CK terminals of the DFF circuits 129 of the line latch circuit 123. At the rise of the horizontal synchronizing signal LP, that is, at the falling timing of the capture signal LPS, the display data DA is captured in the DFF circuits 129 from the DFF circuits 128 of the data latch circuit 122. In other words, the display data DA is captured into the line latch circuit 123 from the data latch circuit 122. At the rising timing of the capture signal LPS, the display data DA is delivered to the level shifter 124. This kind of operation is repeated during one vertical synchronizing period to perform display for one screen of data.

When the display device driven as described above is intended to be made larger, finer and colored, the number of display electrodes must be increased. Accordingly, high-speed drive is necessary and the frequency of the drive signal must be made higher.

After the DFF circuits 128 of the data latch circuit 122 capture the n-bit display data DA delivered last among the display data DA corresponding to one scanning electrode, the segment-side drive circuit 102 loads the display data DA for one scanning electrode from the data latch circuit 122 to the line latch circuit 123 in response to the capture signal LPS which is an inverted signal of the horizontal synchronizing signal LP. However, in case the number of electrodes increases and the frequency is made higher at this time, the normal relationship between the data latch control signal DLC and the capture signal LPS cannot be maintained easily, and the probability of generating an error in capturing the display data DA becomes higher.

More specifically, the data latch control signal DLC supplied to the CK terminals of the DFF circuits 128 and the capture signal LPS supplied to the CK terminals of the DFF circuits 129 are outputted from the control circuit 105, pass through routes different from each other and are supplied to the predetermined terminals. Since the data latch control signal DLC is created from the data latch clock signal DLCK by the shift register of the data latch control circuit 121 as described above, a delay is caused by the elements such as a plurality of flip-flop circuits in the shift register. The amount of the delay increases as the number of electrodes and the number of devices increase.

Referring to FIG. 25, when the DFF circuits 128 capture the m/nth n-bit display data DA in accordance with the data latch control signal DLC (m/n), the display data DA for one scanning electrode, which has been captured in the DFF circuits 128 of the data latch circuit 122, must be loaded to the line latch circuit 123 during the period t1 between the rise of signal DLC (m/n) and the rise of the capture signal LPS. In case such a delay mentioned above occurs at this time and the data latch control signal DLC (m/n) is delayed by the period t1 or more, the period during which data is loaded from the data latch circuit 122 to the line latch circuit 123 ends in such condition that the m/nth display data DA is not captured in the DFF circuits 128, and an error occurs when capturing the display data DA. Furthermore, when the frequency of the drive signal is made higher, an error is likely to occur when capturing the display data DA. Therefore, the display quality is deteriorated. The above-mentioned signal delay occurs not only in the data latch control signal DLC, but also in the capture signal LPS obtained by inverting the horizontal synchronizing signal LP.

When the data latch circuit 122 and the line latch circuit 123 are implemented by using the DFF circuits 128, 129, the number of elements constituting the DFF circuits is relatively large, and the size of an IC (integrated circuit) chip incorporating the DFF circuits becomes larger. When the IC chip is built in a display panel, the peripheral portion of the display panel occupied by the drive circuit not associated with actual display becomes larger, causing an inconvenience. In addition, the production cost of the display panel may be raised as the size of the IC chip is made larger.

SUMMARY OF THE INVENTION

The object of the present invention is to provide a display device capable of securely capturing into the line latch circuits, data signals having been captured in the data latch circuits of the segment-side drive circuit thereof even when the number of electrodes is large and high-speed drive is performed, thereby capable of obtaining excellent display quality.

The present invention relates to a display device comprising:

a display panel wherein a plurality of segment electrodes disposed in parallel with one another are arranged orthogonal to a plurality of scanning electrodes disposed in parallel with one another, the intersections of electrodes are used as pixels, and data signals for determining display conditions are supplied from the segment electrodes to the pixels on the scanning electrodes selected by selection signals sequentially supplied to the scanning electrodes;

a signal output circuit for delivering a clock signal which is to used as the reference of signal output timings, the data signals, the selection signals, a horizontal synchronizing signal to be delivered each time the delivery of the data signal for one scanning electrode ends, and a vertical synchronizing signal to be delivered each time the delivery of the data signals for all the scanning electrodes ends;

a segment-side drive circuit for retaining the data signal for one scanning electrode and for supplying the retained data signal to the segment electrodes; and a common-side drive circuit for sequentially supplying a selection signal to the scanning electrodes, the data signals being delivered in parallel to n (n is an integer of 1 or greater) pieces of segment electrodes within one period of the clock signal, and the parallel signals being delivered x/n times (x is the total of segment electrodes; when x is not an integer multiple of n, a decimal fraction thereof is rounded up) to supply data signals for one scanning electrode, characterized in that the segment-side drive circuit includes:

a data latch control circuit for outputting the first to m/nth (m is an integer multiple of n and the number of segment electrodes to which data signals to be supplied at one time are supplied by the segment-side drive circuit) latch control signals, the logic level of which is inverted while data signals for n pieces of segment electrodes are supplied and the logic level inversion timing values of which are shifted from one another by one period of the clock signal;

a data latch circuit for capturing data signals in accordance with the latch control signal;

a capture signal output circuit for outputting a capture signal for capturing data during the period between the termination of the delivery of the horizontal synchronizing signal and the termination of the delivery of the first clock signal for the next scanning electrode in accordance with the horizontal synchronizing signal and the clock signal;

a line latch circuit for retaining data signals for one scanning electrode retained in the data latch circuit while the capture signal is outputted; and a data output circuit for outputting data signals for one scanning electrode retained in the line latch circuit to the segment electrodes of the display panel, wherein the data latch circuit includes:

a first latch circuit portion comprising n pieces of latch circuits disposed in parallel with one another at the first stage thereof and n pieces of other latch circuits disposed in parallel with one another at the second stage thereof, the latch circuits at the first stage being connected to the latch circuits at the second stage in series, respectively; and a second latch circuit portion comprising (m–n) pieces of latch circuits disposed in parallel with one another and connected to the latch circuits of the first latch circuit portion in parallel so that the first and second latch circuit portions can be used as one latch circuit group of n pieces of latch circuits, among the data signals for one scanning electrode, a data signal to be delivered the first time is retained in the latch circuits at the first stage of the first latch circuit portion in accordance with the first latch control signal;

the data signal retained at the first stage of the first latch circuit portion is retained in the latch circuits at the second stage, and the data signal to be delivered the second time is retained in the latch circuit group of the second latch circuit portion in accordance with the second latch control signal; and the remaining data signals of the data signals for one scanning electrode are retained sequentially in the latch circuit group of the second latch circuit portion in accordance with the third to m/nth latch control signals.

Furthermore, the invention relates to a display device comprising:

a display panel wherein a plurality of segment electrodes disposed in parallel with one another are arranged orthogonal to a plurality of scanning electrodes disposed in parallel with one another, the intersections of electrodes are used as pixels, and data signals for determining display conditions are supplied from the segment electrodes to the pixels on the scanning electrodes selected by selection signals sequentially supplied to the scanning electrodes;

a signal output circuit for delivering a clock signal which is to be used as the reference of signal output timing, the data signals, the selection signals, a horizontal synchronizing signal to be delivered each time the delivery of the data signal for one scanning electrode ends, and a vertical synchronizing signal to be delivered each time the delivery of the data signals for all the scanning electrodes ends;

a segment-side drive circuit for retaining the data signal for one scanning electrode and for supplying the retained data signal to the segment electrodes; and a common-side drive circuit for sequentially supplying a selection signal to the scanning electrodes, the data signals being delivered in parallel to n (n is an integer of 1 or greater) pieces of segment electrodes within one period of the clock signal, and the parallel signals being delivered x/n times (x is the total of segment electrodes; when x is not an integer multiple of n, a decimal fraction thereof is rounded up) to supply data signals for one scanning electrode, characterized in that the segment-side drive circuit includes:

a data latch control circuit for outputting the first to m/nth (m is an integer multiple of n and the number of segment electrodes to which data signals to be supplied at one time are supplied by the segment-side drive circuit) latch control signals, the logic level of which is inverted while data signals for n pieces of segment electrodes are supplied and the logic level inversion timing values of which are shifted from one another by one period of the clock signal;

a data latch circuit for capturing data signals in accordance with the latch control signal;

a capture signal output circuit for outputting a capture signal for capturing data during the period between the termination of the delivery of the horizontal synchronizing signal and the termination of the delivery of the first clock signal for the next scanning electrode in accordance with the horizontal synchronizing signal and the clock signal;

a line latch circuit for retaining data signals for one scanning electrode retained in the data latch circuit while the capture signal is outputted; and a data output circuit for outputting data signals for one scanning electrode retained in the line latch circuit to the segment electrodes of the display panel, wherein the data latch circuit includes:

two first latch circuit portions, each comprising n pieces of latch circuits disposed in parallel with one another at the first stage thereof and n pieces of other latch circuits disposed in parallel with one another at the second stage thereof, the latch circuits at the first stage being connected to the latch circuits at the second stage in series, respectively;

a second latch circuit portion comprising (m−2n) pieces of latch circuits disposed in parallel with one another between the two first latch circuit portions and connected to the latch circuits of the first latch circuit portions in parallel so that the first and second latch circuit portions can be used as one latch circuit group of n pieces of latch circuits; and a switching circuit for disabling the output of the latch circuits at the first stage and for enabling the output of the latch circuits at the second stage of one of the two first latch circuit portions, and for enabling the output of the latch circuits at the first stage and for disabling the output of the latch circuits at the second stage of the other first latch circuit portion, or for enabling the output of the latch circuits at the first stage and for disabling the output of the latch circuits at the second stage of one of the two first latch circuit portions, and for disabling the outputs of the latch circuits at the first stage and for enabling the outputs of the latch circuits at the second stage of the other first latch circuit portion in accordance with the sequence of data signals to be supplied, among the data signals for one scanning electrode, a data signal to be delivered the first time is retained in the latch circuits at the first stage of the first latch circuit portion, the latch circuits at the first stage of which are disabled, in accordance with the first latch control signal;

the data signal retained in the latch circuits at the first stage of one of the first latch circuit portion is retained in the latch circuits at the second stage, and the data signal to be delivered the second time is retained in the latch circuits of the second latch circuit portion in accordance with the second latch control signal; and the remaining data signals of the data signals for one scanning electrode are retained sequentially in the latch circuits of the second latch circuit portion in accordance with the third to (m/n−1)th latch control signals, and retained sequentially in the latch circuits at the first stage of the other first latch circuit portion, the outputs of the latch circuits of the first stage of which is enabled, in accordance with a m/nth latch control signal.

Furthermore, in the invention, the latch circuits constituting the data latch circuit and the line latch circuit are D latch circuits.

Furthermore, in the invention, the latch circuits constituting the data latch circuit are D flip-flop circuits, and the latch circuits constituting the line latch circuit are D latch circuits.

Furthermore, in the invention, the latch circuits constituting the first latch circuit portion of the data latch circuit are D flip-flop circuits, and the latch circuits constituting the second latch circuit portion of the data latch circuit are D latch circuits.

Furthermore, in the invention, the latch circuits constituting the first latch circuit portion of the data latch circuit are D latch circuits, and the latch circuits constituting the second latch circuit portion of the data latch circuit are D flip-flop circuits.

Furthermore, in the invention the capture signal output circuit comprises:

a D flip-flop circuit, supplied with a predetermined power voltage at the data input terminal D and with a horizontal synchronizing signal at the reset terminal R, outputs an output signal, the level of which is the same as that of the input signal, to the data input terminal D from the output terminal Q in accordance with the input signal to the clock terminal CK, retains the output signal from the output terminal Q at the level of the input signal to the data input terminal D as long as the level of the input signal to the data input terminal D remains unchanged, and resets the output signal from the output terminal Q in accordance with the input signal to the reset terminal R;

a NOR circuit, one of the terminals of which is supplied with the output signal from the output terminal Q of the D flip-flop circuit and the other terminal of which is supplied with a clock signal;

a first inversion circuit for inverting the output signal from the NOR circuit and for supplying the inverted signal to the clock terminal CK of the D flip-flop circuit;

a second inversion circuit for inverting the output signal from the output terminal Q of the D flip-flop circuit;

a third inversion circuit for inverting the horizontal synchronizing signal;

a NAND circuit, one of the terminals of which is supplied with the output signal from the second inversion circuit and the other terminal of which is supplied with the output signal from the third inversion circuit; and a fourth inversion circuit for inverting the output signal from the NAND circuit, wherein the output signal from the NAND circuit is used as the capture signal.

In accordance with the invention, to perform display on the display panel having the segment electrodes and the scanning electrodes disposed orthogonal to one another and having the pixels as the intersections of the electrodes, a clock signal used as the reference of output timing of signals, data signals, a selection signal, a horizontal synchronizing signal to be delivered each time the delivery of the data signals for one scanning electrode ends, a vertical synchronizing signal to be delivered each time the delivery of the data signals for all scanning electrodes ends are delivered from the signal output circuit. The data signals are delivered in parallel to n (n is an integer of 1 or greater) pieces of segment electrodes within one period of the clock signal, and the delivery of the parallel signals is performed x/n times (x is the total of the segment electrodes; when x is not an integer multiple of n, its decimal fraction is rounded up) to supply the data signals for one scanning electrode to the segment electrodes.

The data signals for one scanning electrode is supplied to the segment electrodes of the display panel as described below. The data signals for n pieces of segment electrodes to be outputted the first time are retained in n pieces of latch circuits at the first stage of the first latch circuit portion of the data latch circuit, respectively in accordance with the first latch control signal of the latch control signals created by the data latch control circuit. When the second latch control signal is delivered, the data signals retained in the latch circuit at the first stage of the first latch circuit portion are retained in other n pieces of latch circuits at the second stage of the first latch circuit portion, respectively. In addition, the data signals delivered the second time are retained in a group of n pieces of latch circuits in (m−n) pieces of still other latch circuits of the second latch circuit portion, respectively. The remaining data signals of the data signals for one scanning electrode are retained in the remaining latch circuit groups of the second latch circuit portion in accordance with the third to m/nth latch control signals. The latch control signals are signals having timing values shifted from one another by one period of the clock signal in the invention of logic level. m is the number of segment electrodes to which data signals to be delivered at one time are supplied by the segment-side drive circuit, and is an integer multiple of n.

When the data signals for one scanning electrode are retained in the data latch circuit as described above, the retained data signals are retained in the line latch circuit in accordance with the capture signal outputted from the capture signal output circuit. The capture signal is created on the basis of the horizontal synchronizing signal and the clock signal and used to capture data during the period between the termination of the delivery of the horizontal synchronizing signal and the termination of the delivery of the first clock signal to the next scanning electrode. The data signals retained in the data latch circuit are retained in m pieces of latch circuits of the line latch circuit during the period for the capture signal. Furthermore, the data signals for one scanning electrode retained in the line latch circuit is delivered to the segment electrodes of the display panel. This operation is repeated for all scanning electrodes to form a screen of image.

In the latch control signals for retaining data signals in the data latch circuit, a delay occurs between the first latch control signal and the m/nth latch control signal. In the prior art, the capture signal for capturing into the line latch circuit, the data signals retained in the data latch circuit is created on the basis of the horizontal synchronizing signal. The clock signal used as the reference signal when the data signals are captured in the data latch circuit and the horizontal synchronizing signal for creating the capture signal are delivered from the signal output circuit and supplied through paths different from each other, and the period for the capture signal is relatively-short. Therefore, the period for the capture signal ends even when the m/nth data signal is not retained in the data latch circuit, causing a problem that display data for one scanning electrode can not be securely retained in the line latch circuit.

On the other hand, in the present invention, the capture signal is created on the basis of the horizontal synchronizing signal and the clock signal, and the period for the capture signal is relatively long. In other words, the period for the capture signal is between the termination of the delivery of the horizontal synchronizing signal and the termination of the delivery of the first clock signal to the next scanning electrode. Therefore, the data signals for one scanning electrode can be captured in the line latch circuit after having been retained securely, and no data capture error occurs. For this reason, even when the display panel is made larger, finer and colored, and driven at high speed, the data signals for one scanning electrode can be supplied securely to the display panel, which leads to excellent display quality.

Furthermore, in accordance with the invention, the second latch circuit portion having one stage of latch circuits is disposed between the two first latch circuit portions, each having two stages of latch circuits, and the switching circuit for enabling only one of the two first latch circuit portions to function as two stages. With this structure, the sequence of supplying data signals to the segment electrodes can be switched easily as desired by the user. Even in this case, the period for the capture signal is long. Display data can be captured in the line latch circuit after having been securely retained in the data latch circuit, which enables the performance of high-speed drive and results in excellent display quality.

The latch circuits constituting the data latch circuit and the line latch circuit can preferably be comprised of D latch circuits. Since the D latch circuits has relatively fewer elements, the IC chip incorporating the D latch circuits can be made smaller. Therefore, the peripheral portion of the display panel which does not contribute to actual display can be made smaller. Since the IC chip is made smaller, the price of the IC chip can be lowered. The production cost of the display panel can thus be reduced.

It is possible to realize the latch circuits constituting the data latch circuit by using D flip-flop circuits and to realize the latch circuits constituting the line latch circuit by using D latch circuits. Even in this case, display data can be captured in the line latch circuit after having been securely retained in the data latch circuit. Therefore, a display device capable of performing high-speed drive and obtaining excellent display quality can be achieved.

Furthermore, it is possible to realize the latch circuits constituting the first latch circuit portion of the data latch circuit by using D flip-flop circuits and to realize the latch circuits constituting the second latch circuit portion by using D latch circuits. Conversely, it is also possible to realize the latch circuits constituting the first latch circuit portion by using D latch circuits and to realize the latch circuits constituting the second latch circuit portion by using D flip-flop circuits. By using greater numbers of D latch circuits, the peripheral portion of the display panel can be made smaller, and the cost of production can be reduced.

The capture signal output circuit comprises a D flip-flop circuit, a NOR circuit, a NAND circuit and a first to a fourth inversion circuits. A predetermined power voltage is applied to the data terminal D of the D flip-flop circuit, and a horizontal synchronizing signal is supplied to the reset terminal R. An output signal, the level of which is the same as that of the input signal to the data terminal D, is outputted from the output terminal Q in accordance with the input signal to the clock terminal CK. The output signal from the output terminal Q is retained as long as the level of the input signal to the data terminal D remains unchanged. The output signal from the output terminal Q is reset in accordance with the input signal to the reset terminal R. In addition, the output signal from the output terminal Q of the D flip-flop circuit is supplied to one of the two terminals of the NOR circuit, and a clock signal is supplied to the other terminal. The output signal from the NOR circuit is inverted by the first inversion circuit and supplied to the clock terminal CK of the D flip-flop circuit. The output signal from the output terminal Q of the D flip-flop circuit is inverted by the second inversion circuit and supplied to one of the two terminals of the NAND circuit, and the horizontal synchronizing signal is inverted by the third inversion circuit and supplied to the other terminal of the NAND circuit. The output signal from the NAND circuit is inverted by the fourth inversion circuit and used as the capture signal. With this circuit structure, the capture signal for capturing data signals in the line latch circuit can be created.

As described above, in the invention, the capture signal for capturing into the line latch circuit, data signals retained in the data latch circuit can be created on the basis of the horizontal synchronizing signal and the clock signal, and the capture signal can be delivered for a relatively long period. Therefore, the data signals for one scanning electrode can be captured in the line latch circuit after having been retained securely in the data latch circuit. Even when the latch control signal for capturing data signals in the data latch circuit is delayed, no data signal capture error occurs. High-speed drive for obtaining excellent display quality can thus be achieved.

Furthermore, display data can be supplied to the segment electrodes sequentially in accordance with the preference of the user by enabling only one of the two first latch circuit portions to function as two stage latch circuits by using the switching circuit.

Furthermore, the IC chip can be made smaller and the peripheral portion of the display panel can also be made smaller by realizing the latch circuits constituting the data latch circuit and the line latch circuit by using D latch circuits. Moreover, since the IC chip is made smaller, the price can be lowered and the cost of production can be reduced.

Furthermore, it is also possible to realize the data latch circuit by using D flip-flop circuits and to realize the line latch circuit by using the D latch circuits. Even in this case, the capture signal is delivered for a relatively long period. Since the data signals for one scanning electrode can be captured in the line latch circuit after having been retained securely in the data latch circuit, no data signal capture error occurs. Therefore, high-speed drive for obtaining excellent display quality can be achieved.

Furthermore, it is possible to realize the latch circuits constituting the first latch circuit portion of the data latch circuit by using D flip-flop circuits and to realize the latch circuits constituting the second latch circuit portion by using D latch circuits. Conversely, it is also possible to realize the latch circuits constituting the first latch circuit portion by using D latch circuits and to realize the latch circuits constituting the second latch circuit portion by using D flip-flop circuits. By using greater numbers of D latch circuits, the peripheral portion of the display panel can be made smaller, and the cost of production can be reduced.

Furthermore, the capture signal can be created by the capture signal output circuit comprising a D flip-flop circuit, a NOR circuit, a NAND circuit and a first to a fourth inversion circuit.

BRIEF DESCRIPTION OF THE INVENTION

Other and further objects, features, and advantages of the invention will be more explicit from the following detailed description taken with reference to the drawings wherein.

Figure 9:
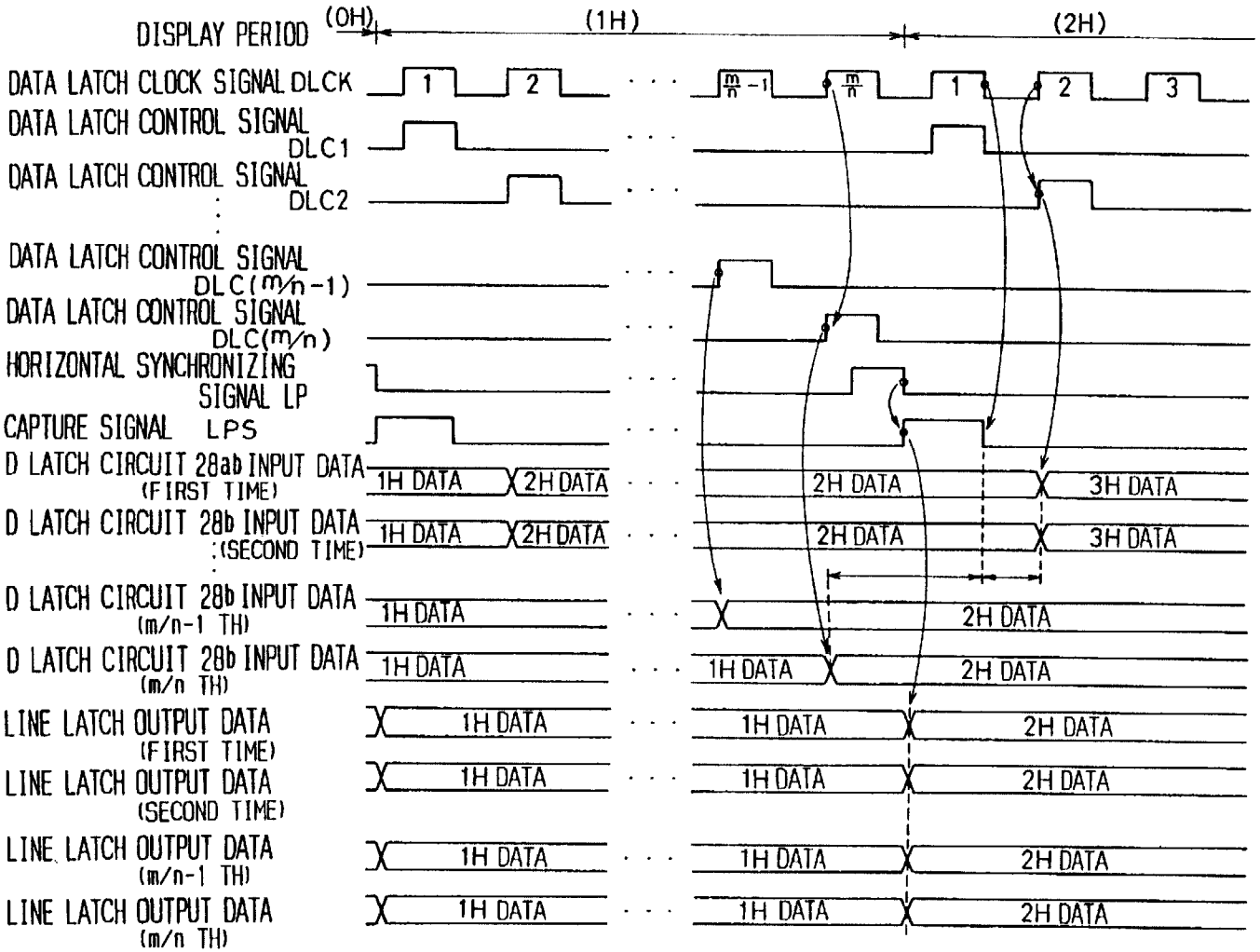
Figure 10:
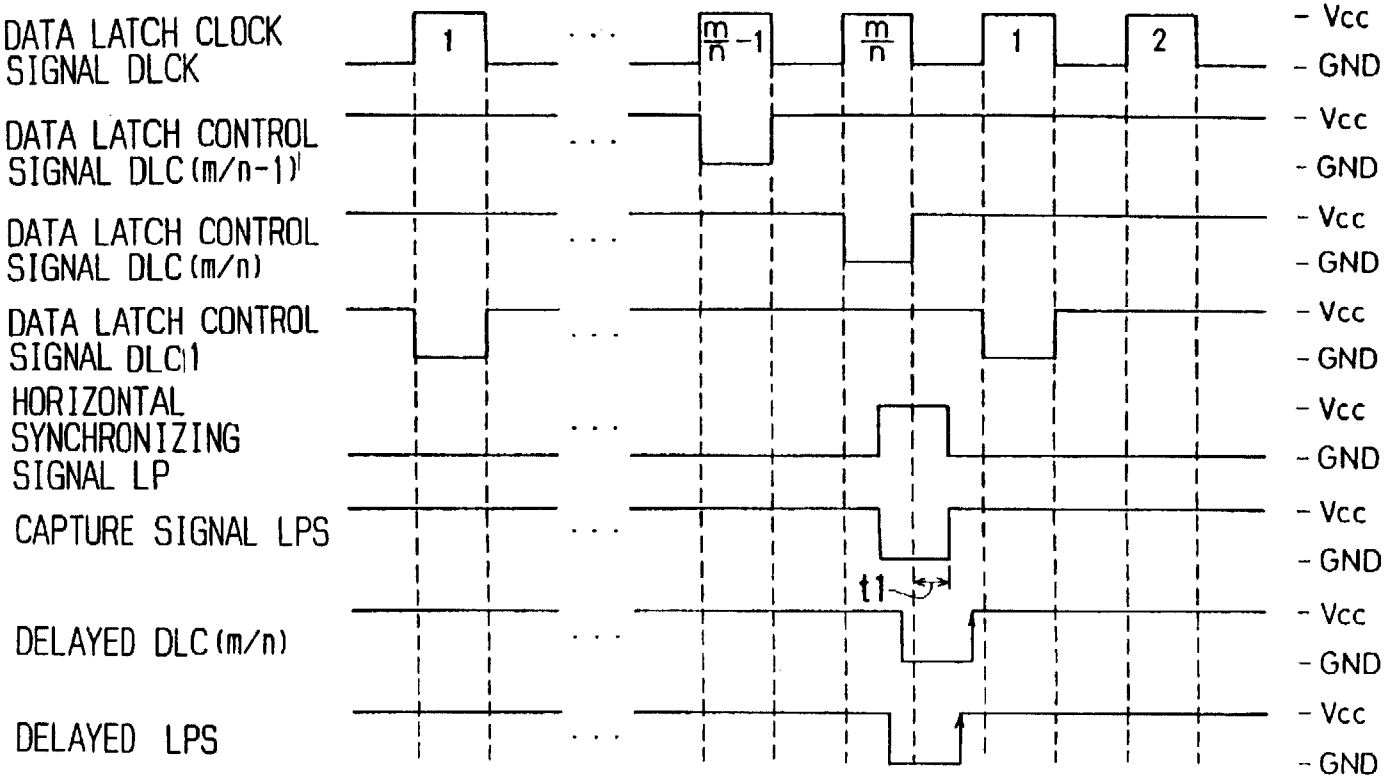
FIG. 10 Prior Art
Figure 11:
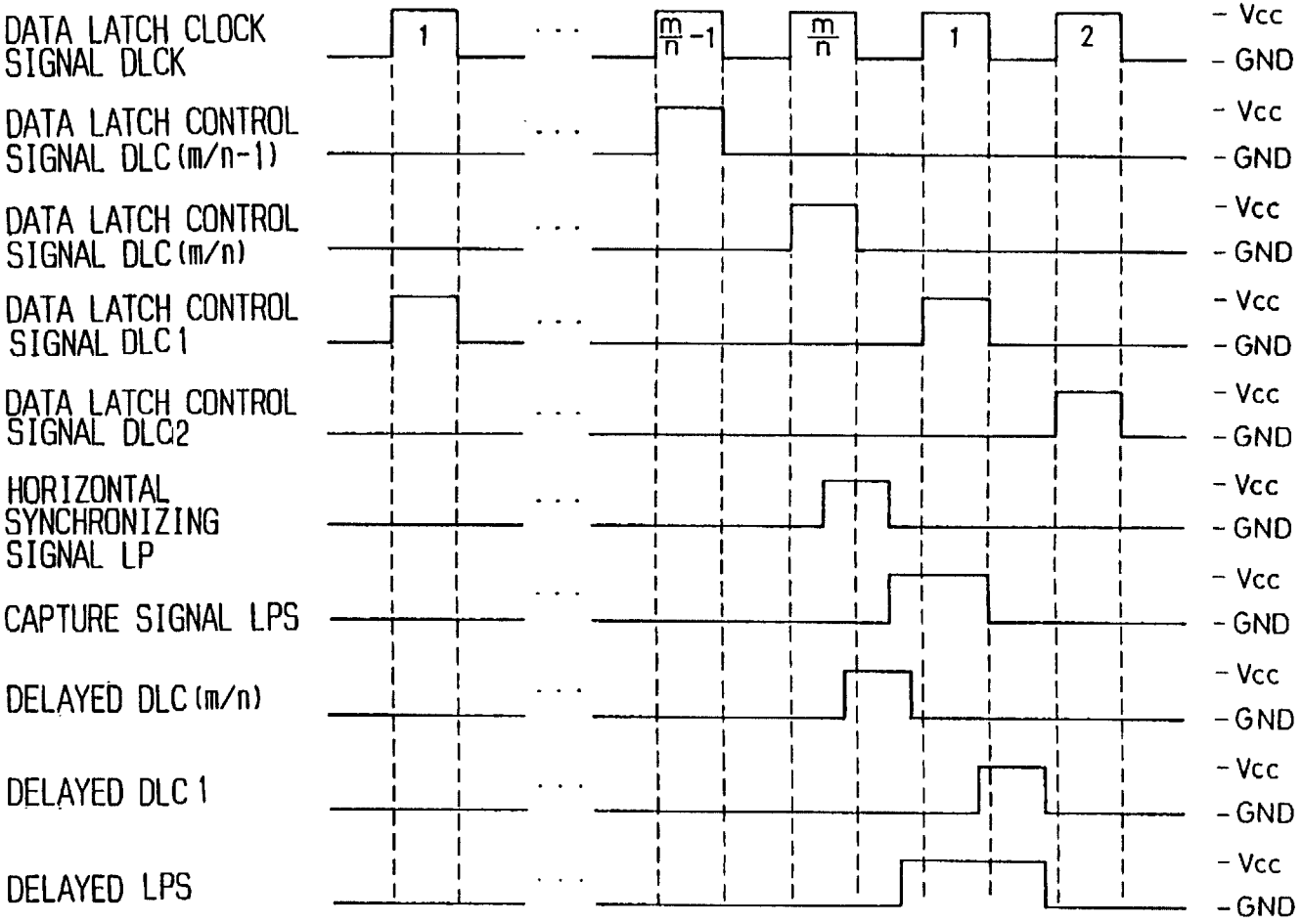
Figure 12:
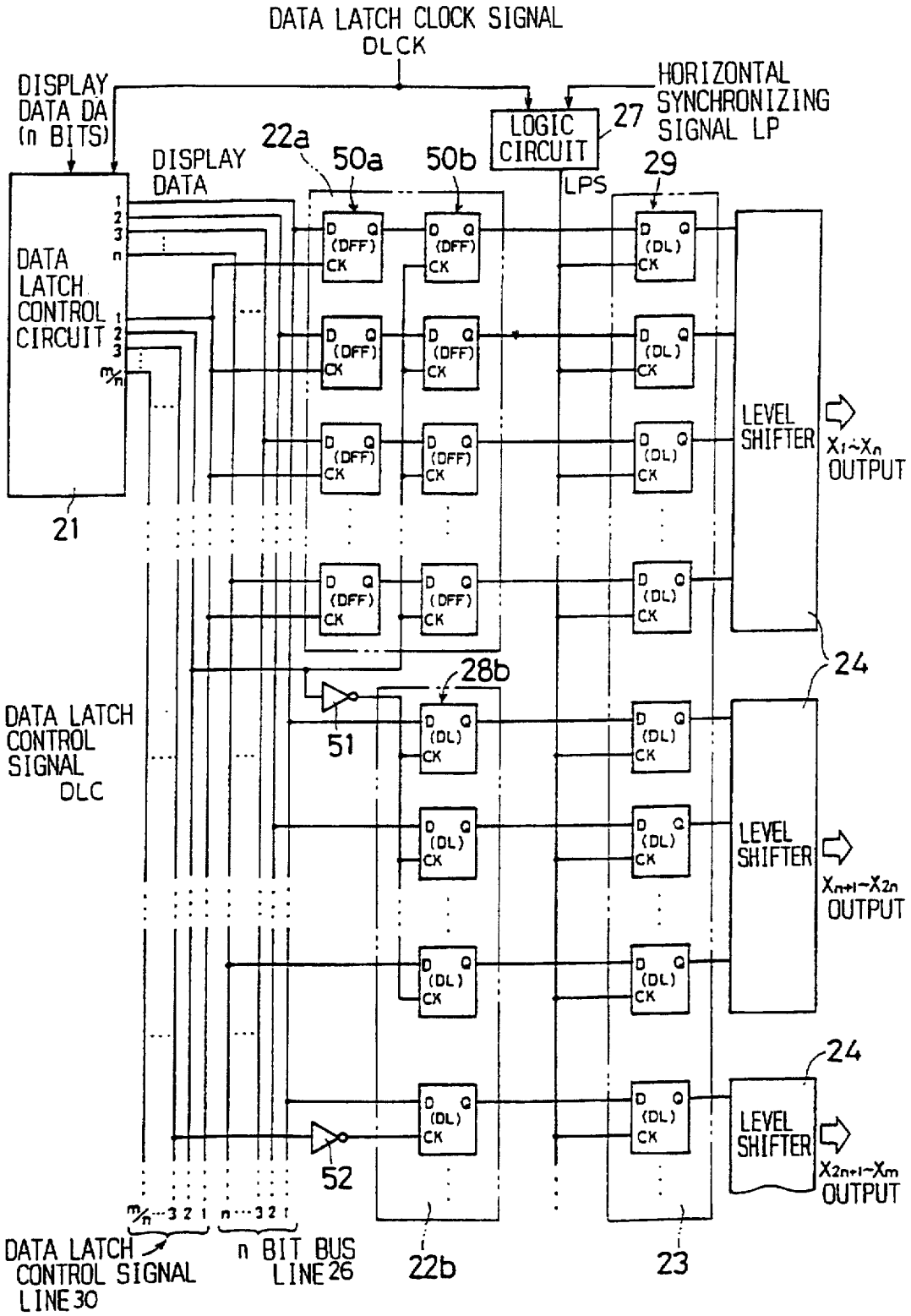
Figure 13:
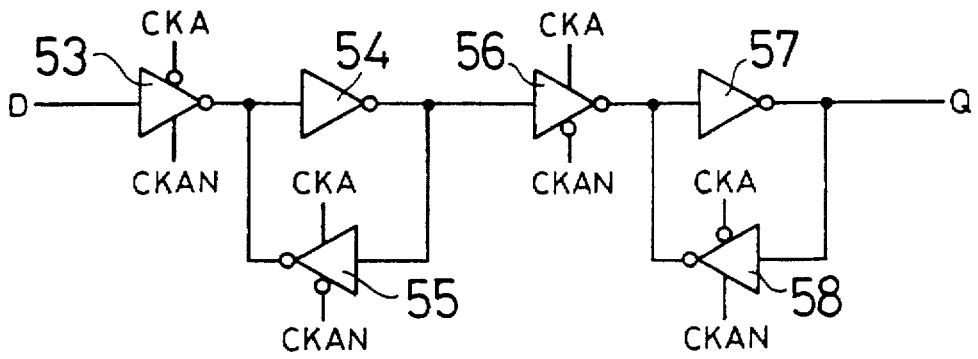
Figure 14:
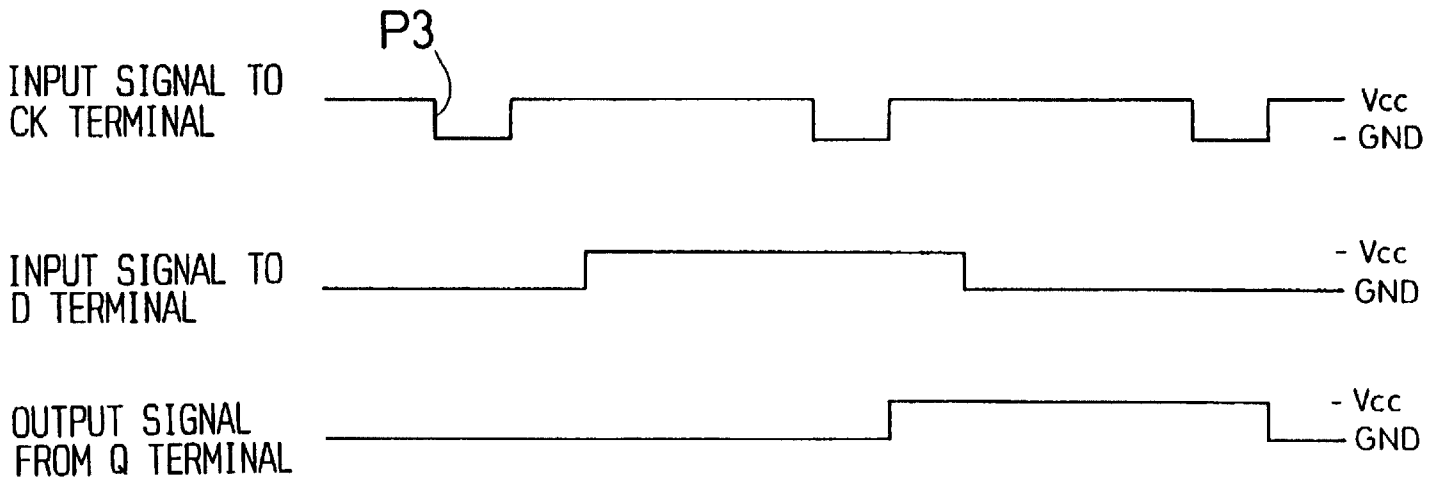
Figure 15:
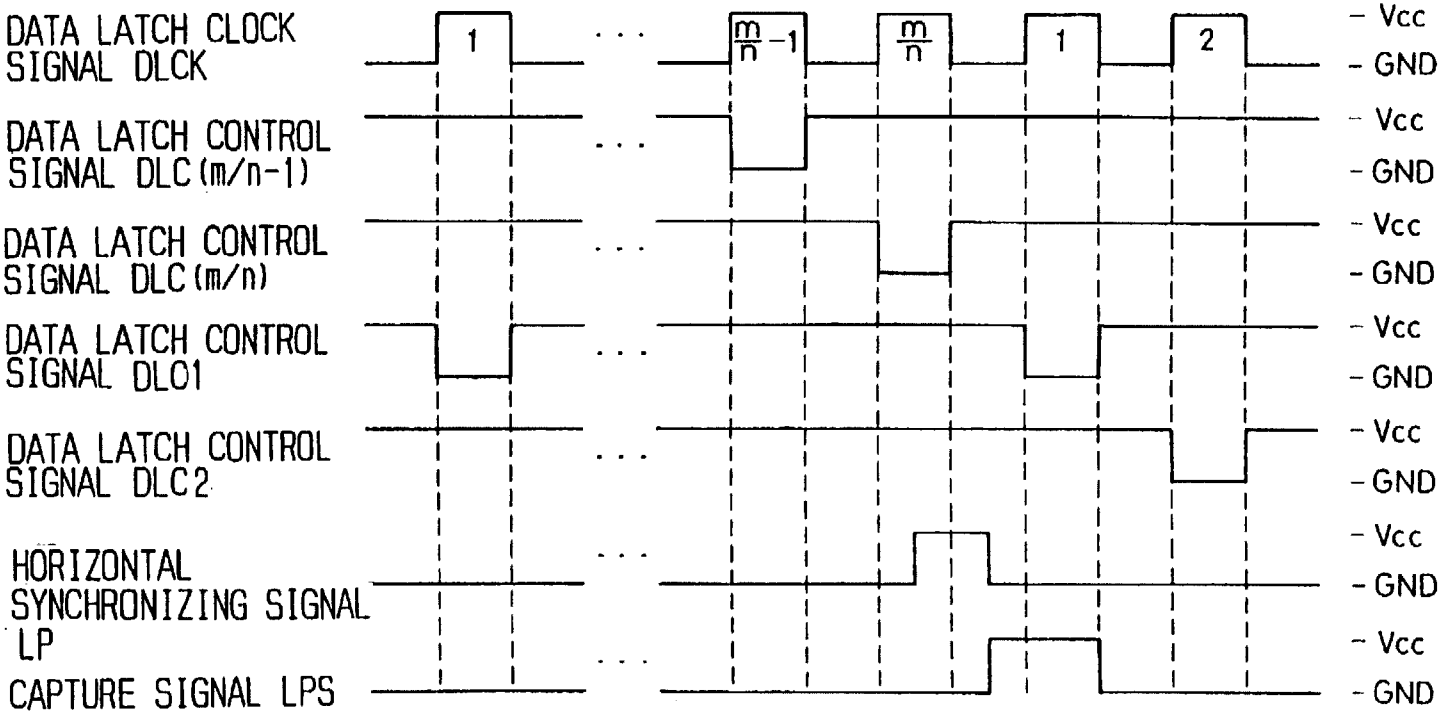
Figure 16:
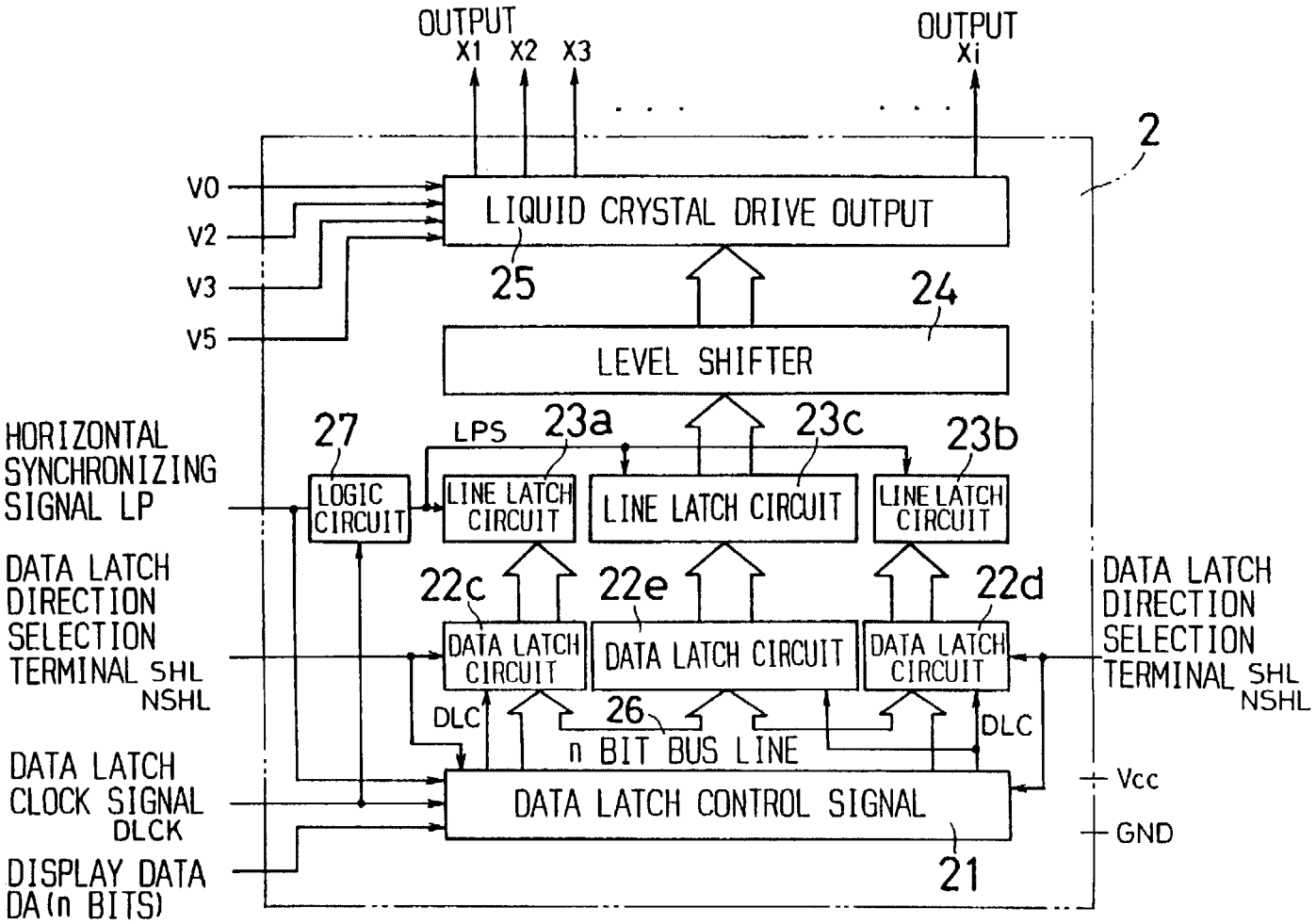
Figure 17:
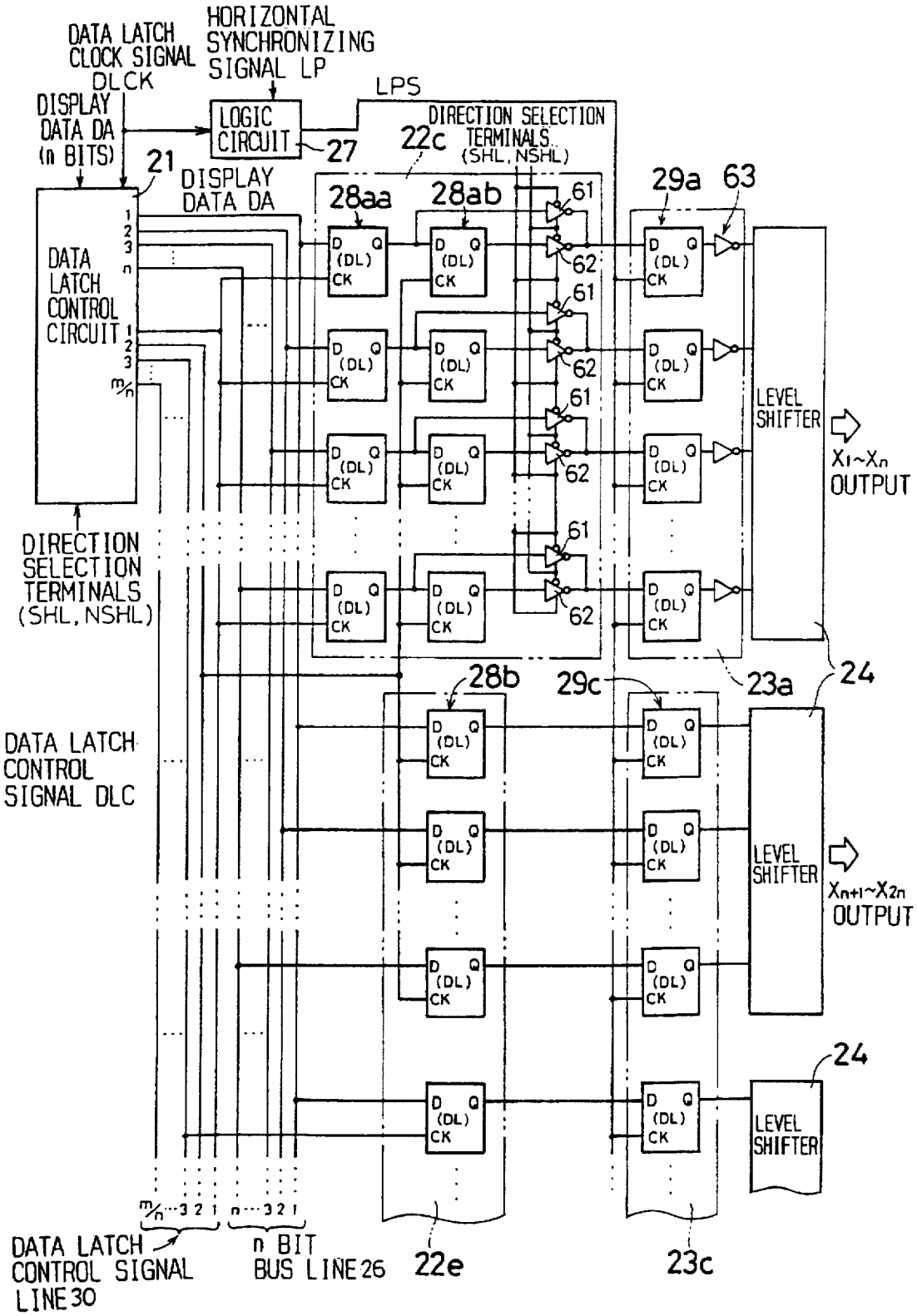
Figure 18:
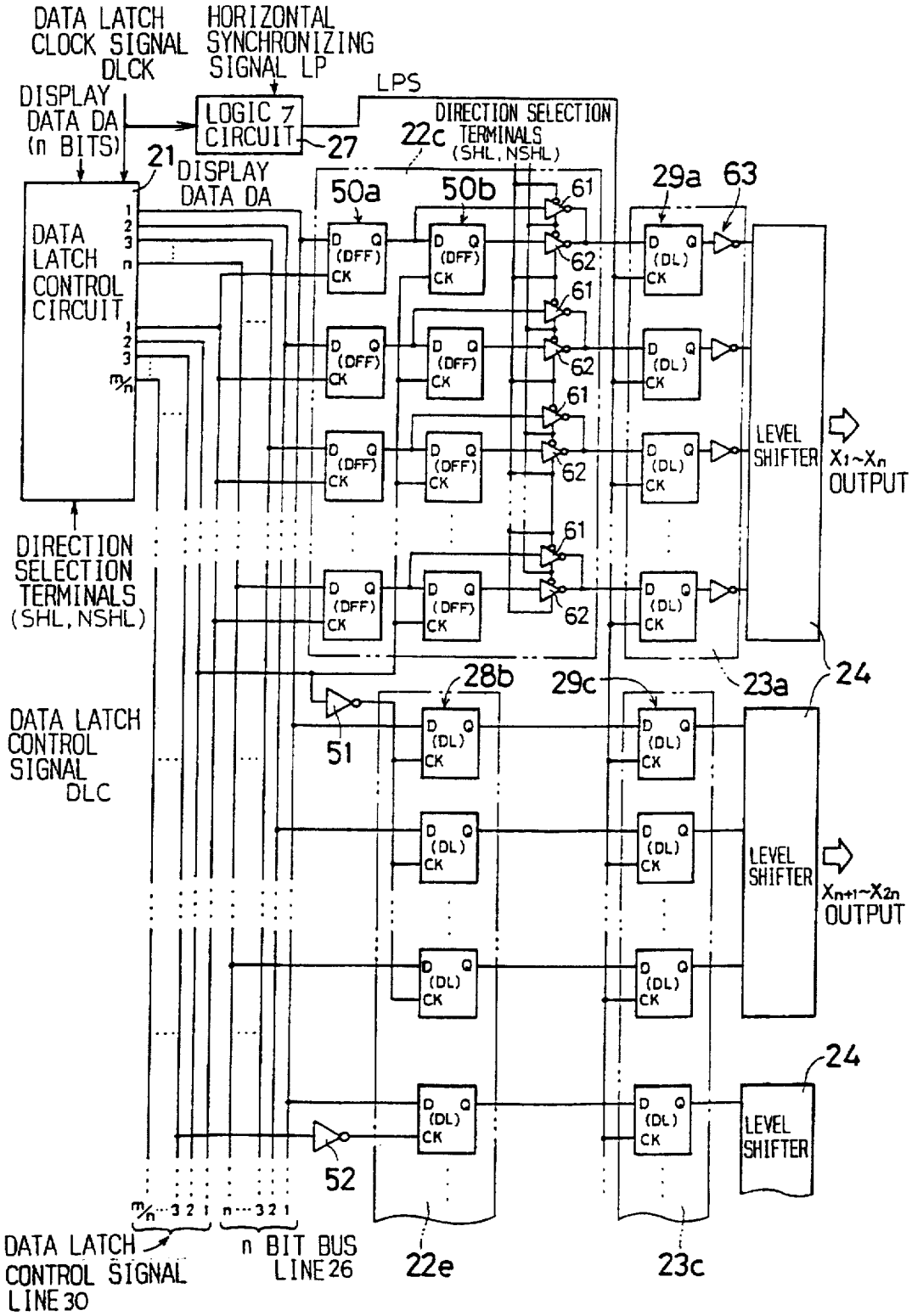
Figure 19:
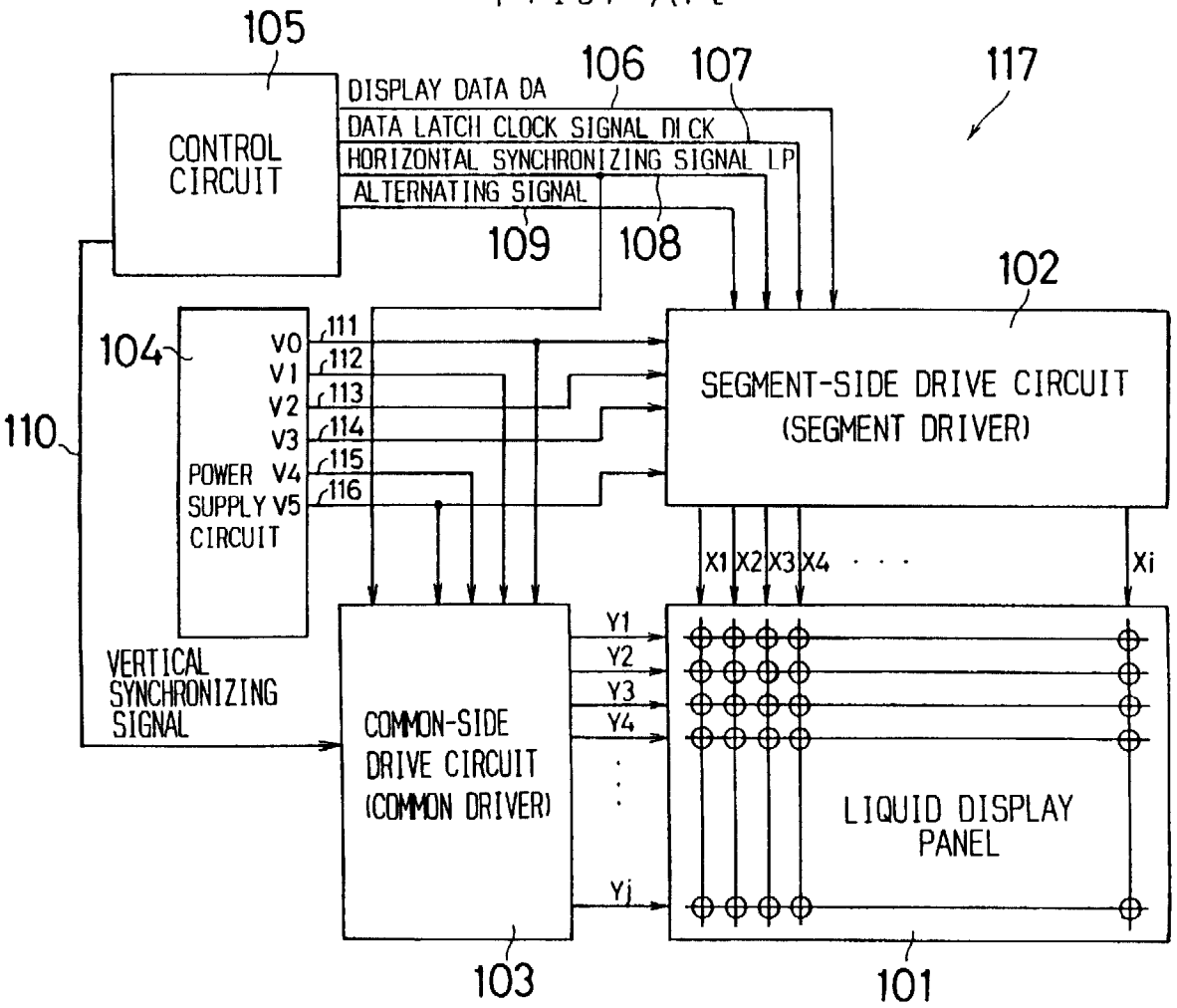
FIG. 19 Prior Art
Figure 20:
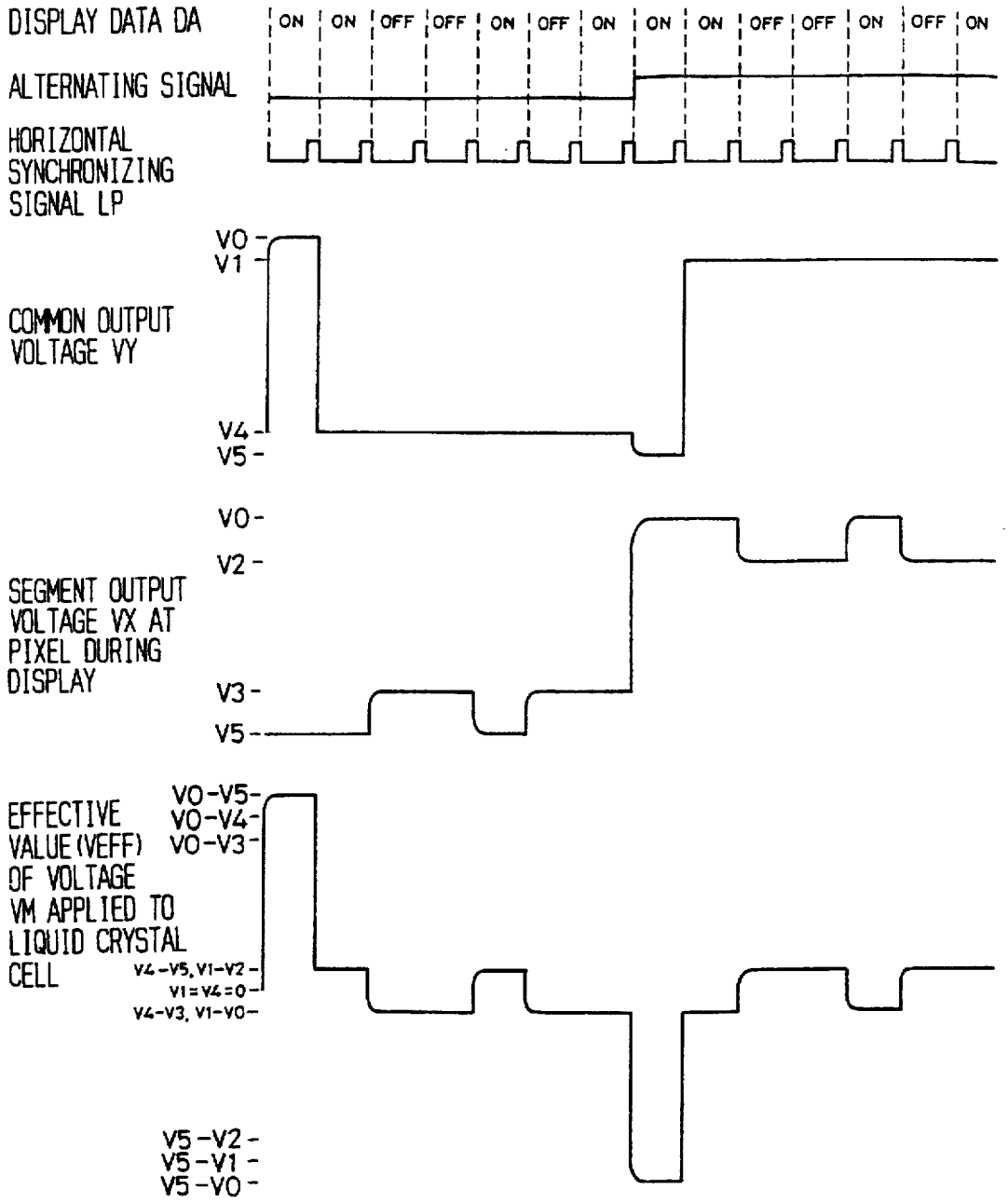
FIG. 20 Prior Art
Figure 21:
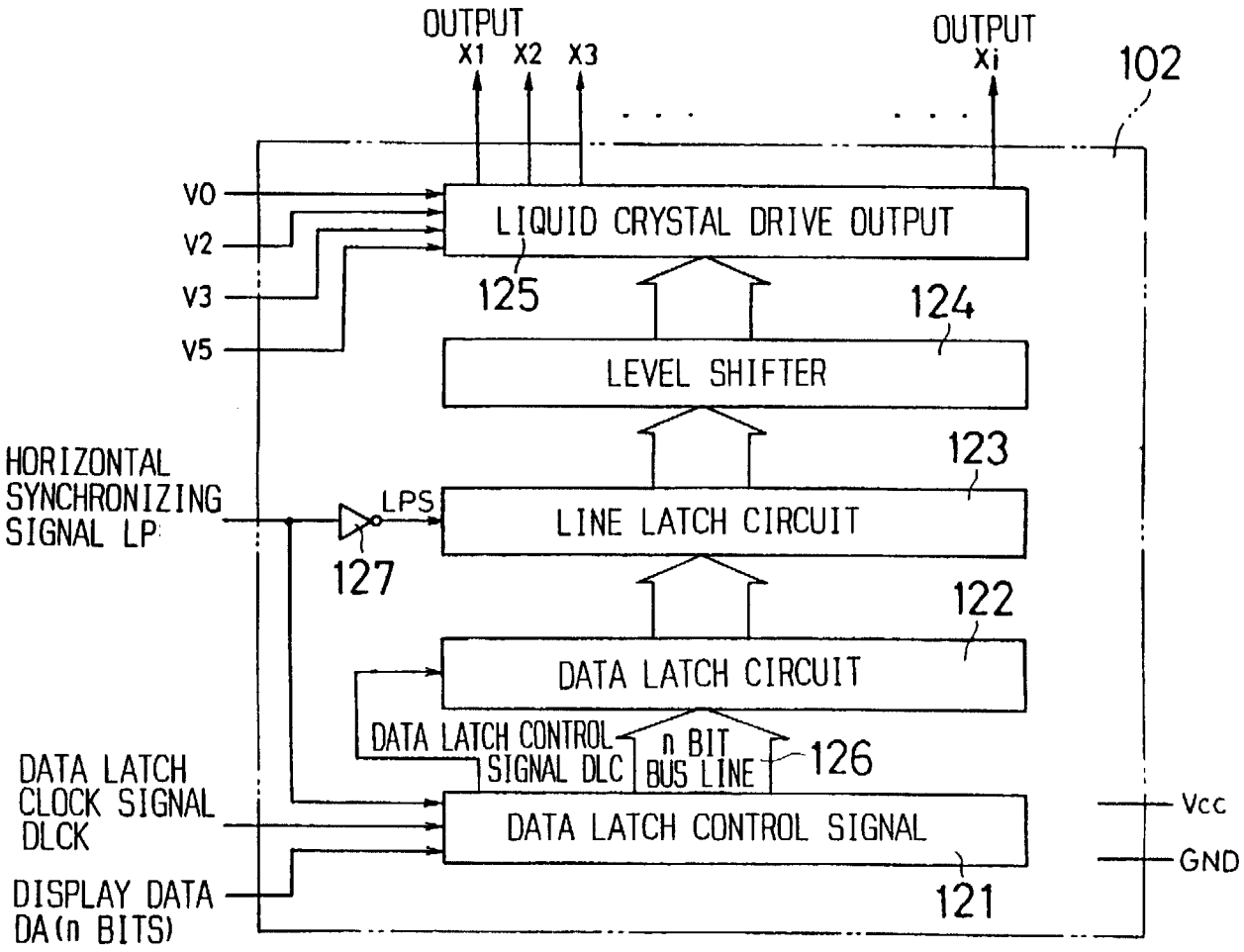
FIG. 21 Prior Art
Figure 22:
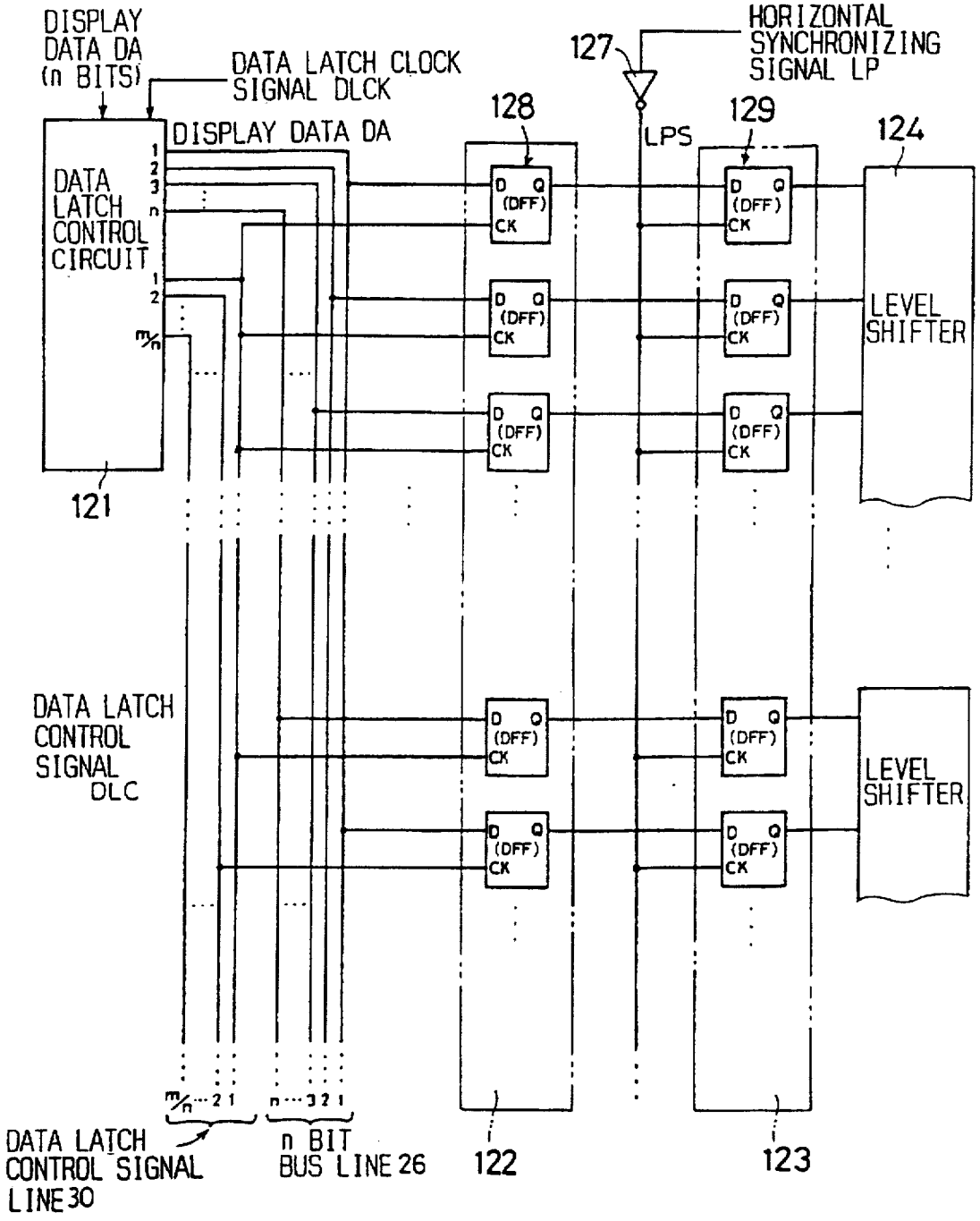
FIG. 22 Prior Art
Figure 23A:
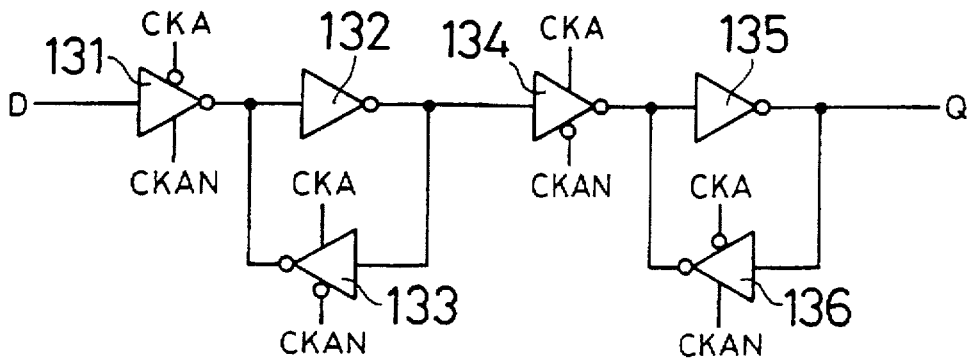
FIG. 23A Prior Art
Figure 23B:
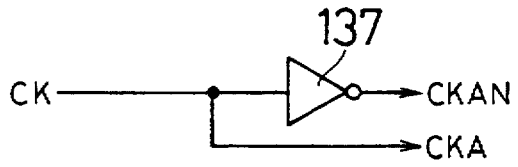
FIG. 23B Prior Art
Figure 24:
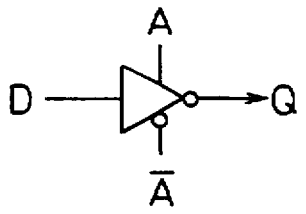
FIG. 24 Prior Art
Figure 25:
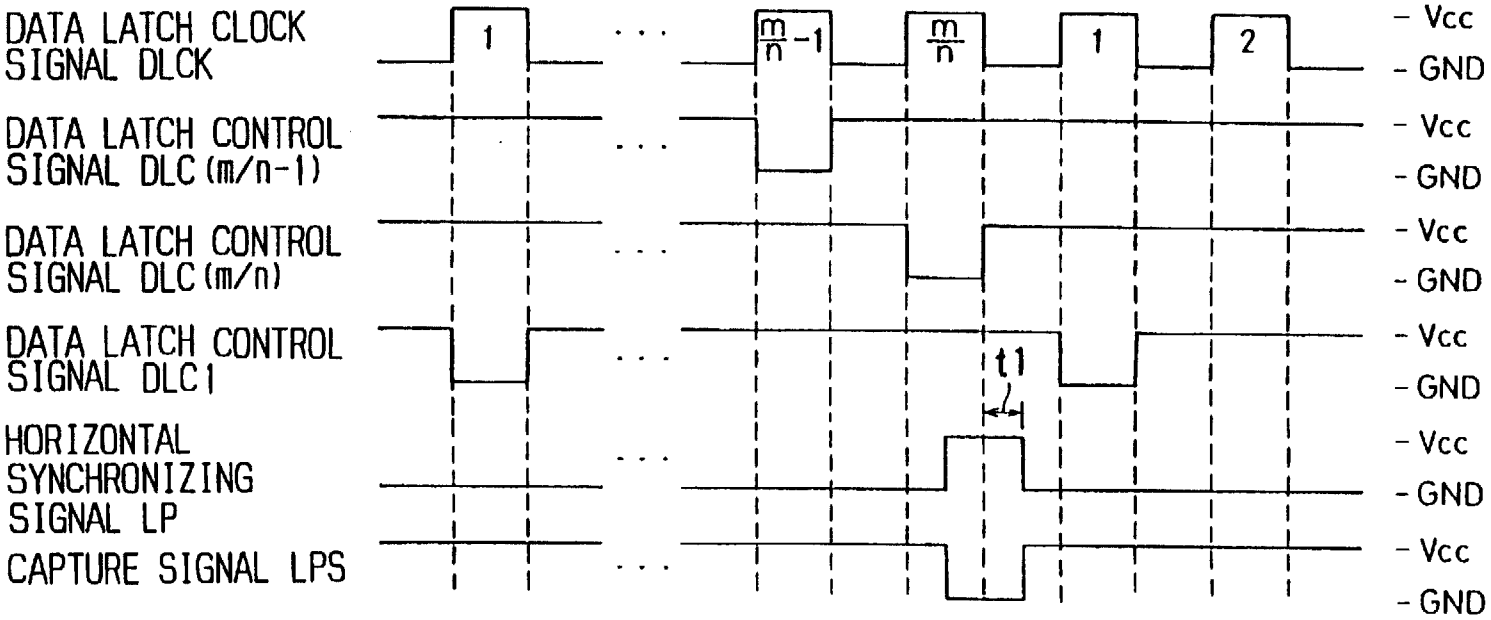
FIG. 25 Prior Art

FIG. 9 is a timing chart showing the operations of a data latch control circuit 21, data latch circuits 22a, 22b and a line latch circuit 23 of the segment-side drive circuit 2;

FIG. 10 is a timing chart showing the output operation of the display data for a display device in accordance with a conventional embodiment;

FIG. 11 is a timing chart showing the output operation of the display data for the liquid crystal display device 17 in accordance with the invention;

FIG. 12 is a circuit diagram showing the data latch circuits 22a, 22b and the line latch circuit 23 of a liquid crystal display device in accordance with another embodiment of the invention;

FIG. 13 is a circuit diagram showing the configuration of DFF circuits 50a, 50b;

FIG. 14 is a timing chart showing the operation of the DFF circuit;

FIG. 15 is a timing chart showing the output operation of the display data for the liquid crystal display device;

FIG. 16 is a block diagram showing the configuration of the segment-side drive circuit 2 of a liquid crystal display device in accordance with still another embodiment of the invention;

FIG. 17 is a circuit diagram showing the data latch circuits 22c, 22e and the line latch circuits 23a, 23c of the liquid crystal display device;

FIG. 18 is a circuit diagram showing the configuration of a further embodiment of the invention, wherein DFF circuits 50a, 50b are used instead of the D latch circuits 28aa, 28ab shown in FIG. 17;

FIG. 19 is a block diagram showing the electrical configuration of a liquid crystal display device 117 having a segment-side drive circuit 102 in accordance with a conventional embodiment;

FIG. 20 is a timing chart showing signals supplied to a liquid crystal panel 101;

FIG. 21 is a block diagram showing the configuration of the segment-side drive circuit 102;

FIG. 22 is a circuit diagram showing the configuration of the data latch circuit 122 and the line latch circuit 123 in accordance with the conventional embodiment;

FIGS. 23A, 23B are circuit diagrams showing the structures of DFF circuits 128, 129 in accordance with the conventional embodiment;

FIG. 24 is a circuit diagram for explaining the operation of a clocked inverter; and FIG. 25 is a timing chart showing the operations of the data latch control circuit 121, the data latch circuit 122 and the line latch circuit 123 of the segment-side drive circuit 102.

DETAILED DESCRIPTION OF PREFERRED EMBODIMENTS

Now referring to the drawings, preferred embodiments of the invention are described below.

Figure 1:
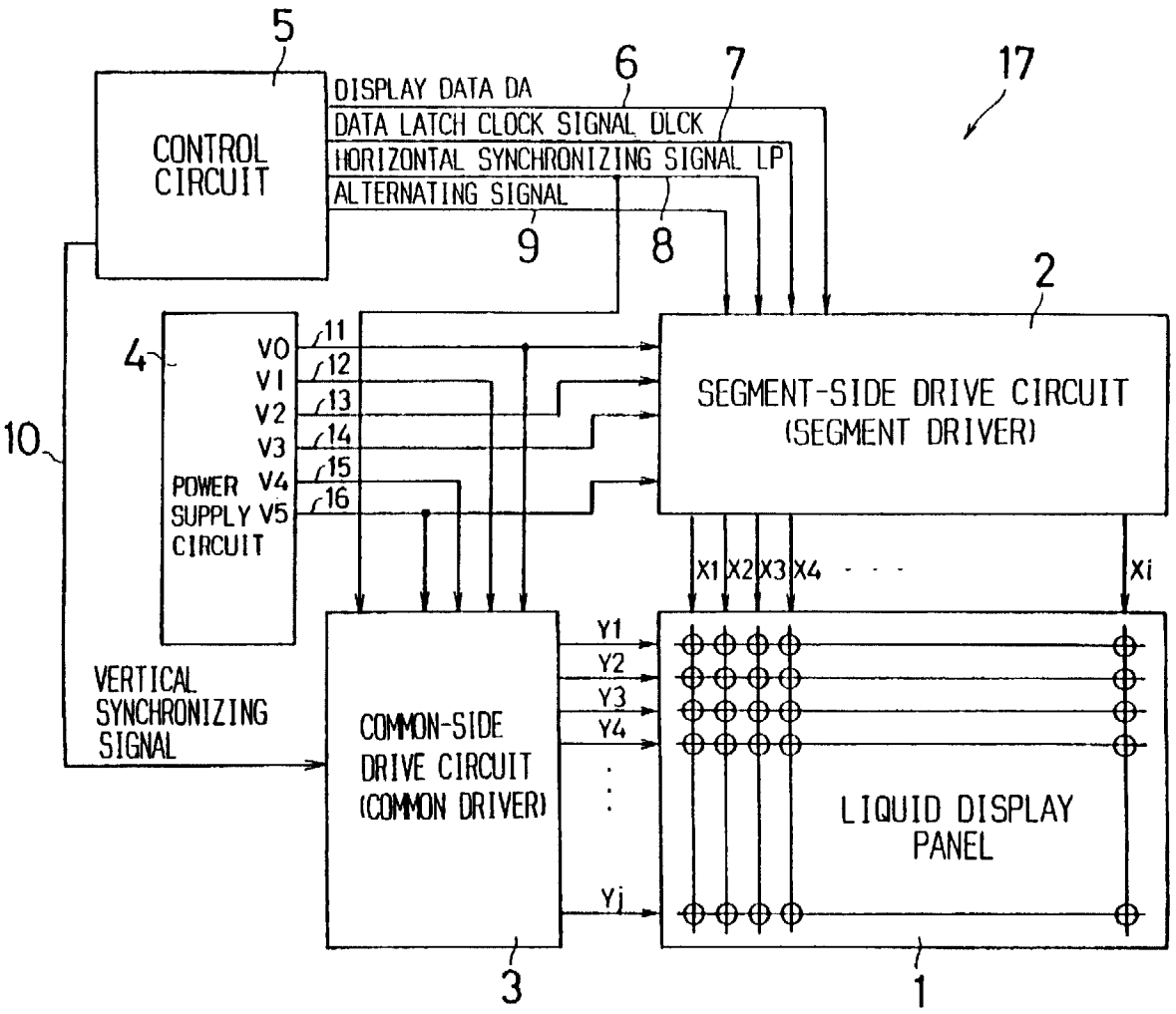
FIG. 1 is a block diagram showing the electrical configuration of a liquid crystal display device 17 in accordance with an embodiment of the present invention.

FIG. 1 is a block diagram showing the electrical configuration of a liquid crystal display device 17 in accordance with an embodiment of the present invention. The liquid crystal display device 17 comprises a liquid crystal panel 1, a segment-side drive circuit 2, a common-side drive circuit 3, a power supply circuit 4 and a control circuit 5.

A liquid crystal panel 1 is formed by disposing a liquid crystal between a pair of substrate members. When one of the pair of substrate members is a transmission panel, for example, the substrate member has an insulating transparent substrate and stripe-shaped segment electrodes X1 to Xi arranged on the transparent substrate at equal intervals in parallel with one another. In addition, the other substrate member has an insulating transparent substrate and stripe-shaped scanning electrodes Y1 to Yj arranged on the transparent substrate at equal intervals in parallel with one another. Furthermore, the one and the other substrate members have liquid crystal orientation films covering the arranged electrodes X1 to Xi and Y1 to Yj. The liquid crystal panel 1 uses the intersections of the segment electrodes X1 to Xi and the scanning electrodes Y1 to Yj as pixels and performs display by combining a plurality (i×j) of pixels.

From the control circuit 5, display data DA, a data latch clock signal DLCK, a horizontal synchronizing signal LP and an alternating signal are supplied to the segment-side drive circuit 2 via signal lines 6, 7, 8 and 9, respectively. In addition, a vertical synchronizing signal is supplied to the common-side drive circuit 3 via a signal line 10. The horizontal synchronizing signal LP is also supplied to the common-side drive circuit 3.

From the power supply circuit 4, power voltage signals V0 to V5 having six different voltages are delivered to power voltage lines 11 to 16. The power voltage signals V0, V2, V3 and V5 are supplied to the segment-side drive circuit 2, and the power voltage signals V0, V1, V4 and V5 are supplied to the common-side drive circuit 3.

Figure 2:
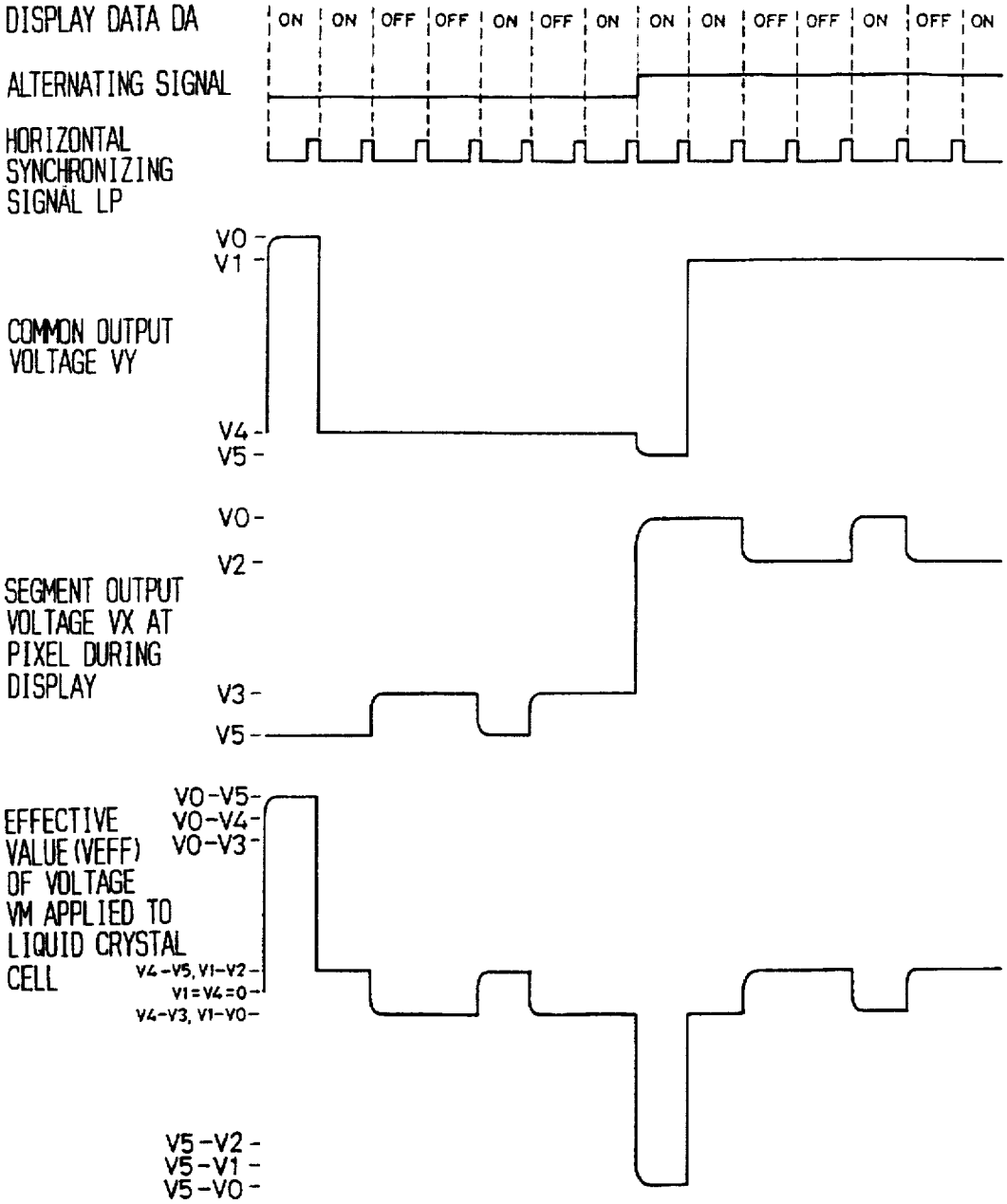
FIG. 2 is a timing chart showing signals supplied to a liquid crystal panel 1.

FIG. 2 is a timing chart showing signals supplied to the liquid crystal panel 1. The following explanation is given by paying attention to the electrodes X1 and Y1. The segment output voltage signal VX (V0, V2, V3, V5) shown in FIG. 2 is supplied to the segment electrode X1 to perform display on the basis of the display data DA shown in FIG. 2. Signal V5 is supplied during the period between the fall of the horizontal synchronizing signal LP shown in FIG. 2 and the fall of the next horizontal synchronizing signal LP, signal V5 is also supplied during the period between the next horizontal synchronizing signal LP and the fall of the further next horizontal synchronizing signal LP, and signal V3 is supplied during the period between the further next horizontal synchronizing signal LP and the fall of the yet further horizontal synchronizing signal LP. More specifically, to each scanning electrode, signal V5 is supplied when the display data DA is on, and signal V3 is supplied when the display data DA is off. The period during which the horizontal synchronizing signal LP is delivered j times (j: the number of the scanning electrodes) corresponds to one vertical synchronizing period. During the next vertical synchronizing period, the signal level of the alternating signal shown in FIG. 2 is switched. When the signal level of the alternating signal is switched, the signal level of the segment output voltage signal is changed. When the display data DA is on, signal V0 is supplied, and when the display data DA is off, signal V2 is supplied.

To the scanning electrode Y1, the common output voltage signal VY (V0, V1, V4, V5) shown in FIG. 2 is supplied. More specifically, signal V0 is supplied during the period between the fall of the horizontal synchronizing signal LP and the fall of the next horizontal synchronizing signal LP, and signal V4 is supplied during the period between the next horizontal synchronizing signal LP and the fall of the further next horizontal synchronizing signal LP. During the next period following the period during which signal V0 is supplied to the scanning electrode Y1, signal V0 is supplied to the scanning electrode Y2 adjacent to the scanning electrode Y1. Hereinafter, signal V0 is supplied to the scanning electrodes Y3, Y4, . . . , Yj in this sequence in the same way, and the electrodes Y1 to Yj are selected in this sequence, respectively. Signal V0 is supplied to electrodes selected from the scanning electrodes Y1 to Yj, and signal V4 is supplied to the nonselected electrodes of the scanning electrodes Y1 to Yj. During the next vertical synchronizing period, signal V5 is supplied to electrodes selected from the scanning electrodes Y1 to Yj, and signal V1 is supplied to the nonselected electrodes Y1 to Yj.

By supplying signals in this way, voltage VM is applied to the liquid crystal panel 1 as shown in FIG. 2. The voltage VM is applied to the intersection of the electrodes X1 and Y1. Voltage (V0–V5) is applied during the period between the fall of the horizontal synchronizing signal LP and the fall of the next horizontal synchronizing signal LP, voltage (V4–V5) is applied during the period between the next horizontal synchronizing signal LP and the fall of the further next horizontal synchronizing signal LP, and voltage (V4–V3) is applied during the next period. During the next vertical synchronizing period, voltage (V5–V0) is applied during the period between the fall of the horizontal synchronizing signal LP and the fall of the next horizontal synchronizing signal LP, voltage (V1–V0) is applied during the period between the next horizontal synchronizing signal LP and the fall of the further next horizontal synchronizing signal LP, and voltage (V1–V2) is applied during the next period. In other words, the logic level of the voltage is inverted each time the vertical synchronizing signal is obtained.

Figure 3:
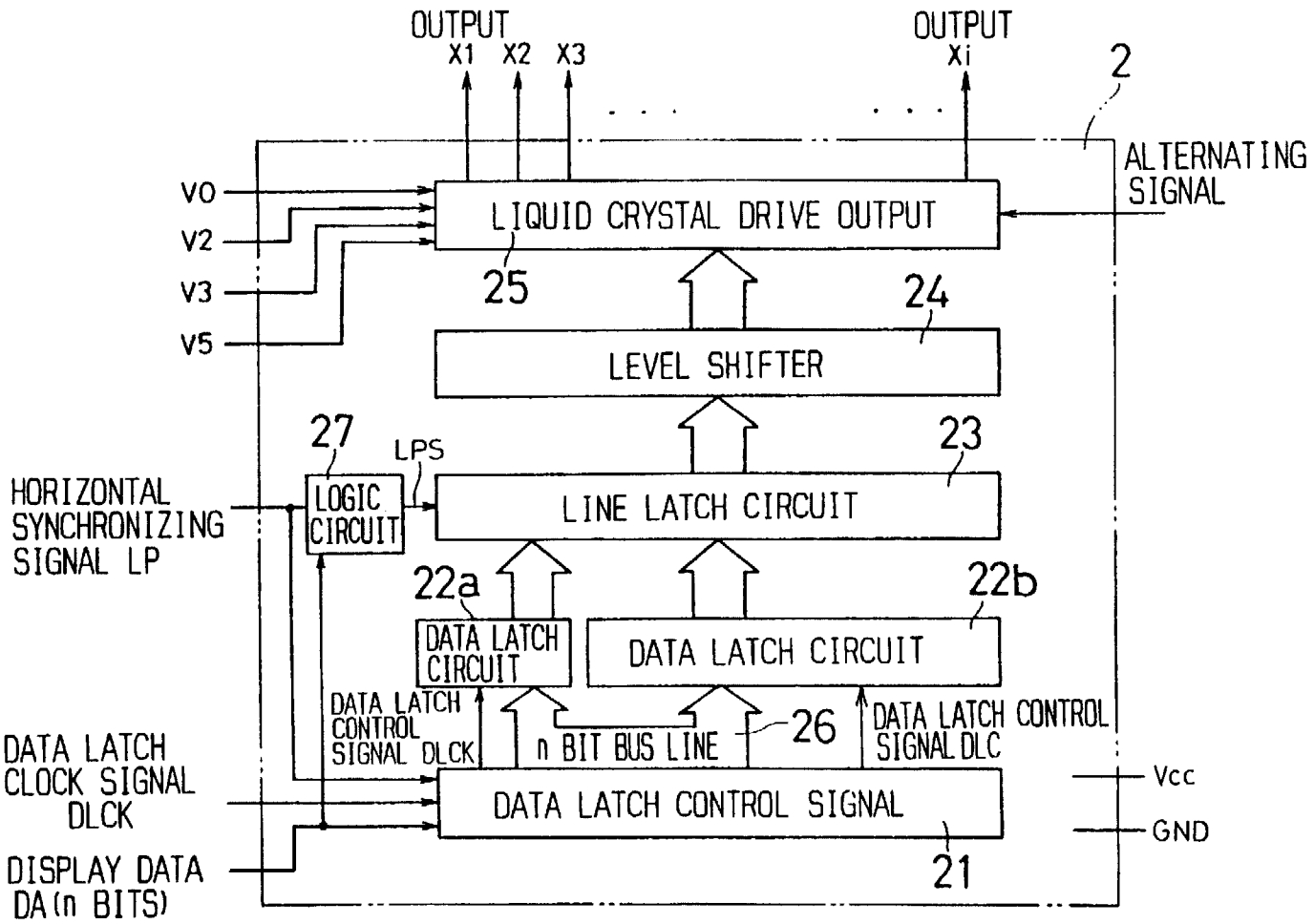
FIG. 3 is a block diagram showing the configuration of a segment-side drive circuit 2.

FIG. 3 is a block diagram showing the configuration of the segment-side drive circuit 2. The control circuit 5 delivers m bits of display data DA for one scanning electrode n bits at a time. Here, n is an integer of 1 or greater and m is selected to be an integer multiple of n. In this embodiment, a single drive circuit having m outputs is used as the segment-side drive circuit 2. A plurality of such circuits may be used. Furthermore, in this embodiment, the total i of the segment electrodes is an integer multiple of n, that is, m=i. When the total i of the segment electrodes is not an integer multiple of n, its decimal fraction is rounded up. That is to say, the number of data bits to be supplied from the segment-side drive circuit 2 is made larger than the total i of the segment electrodes.

The segment-side drive circuit 2 comprises a data latch control circuit 21, data latch circuits 22*a*, 22*b*, a line latch circuit 23, level shifters 24, a liquid crystal drive output circuit 25 and a logic circuit 27. To drive the segment-side drive circuit 2, power voltage Vcc and ground potential GND are supplied.

To the data latch control circuit 21, the n-bit display data DA, the data latch lock signal DLCK and the horizontal synchronizing signal LP are supplied. The data latch control signal DLC is created on the basis of the data latch clock signal DLCK and supplied to the data latch circuits 22*a*, 22*b*. The data latch control circuit 21 is connected to the data latch circuits 22*a*, 22*b* via an n-bit bus line 26. The display data DA supplied to the data latch control circuit 21 is stored in the data latch circuits 22*a*, 22*b*.

When the display data DA for one line is stored in the data latch circuits 22*a*, 22*b*, the display data DA is supplied to the line latch circuit 23 and the level shifters 24. The display data DA for one scanning electrode stored in the data latch circuits 22*a*, 22*b* is captured in the line latch circuit 23 on the basis of the capture signal LPS created by the logic circuit 27. The data latch clock signal DLCK and the horizontal synchronizing signal LP are supplied to the logic circuit 27. The capture signal LPS is created from these signals. To the liquid crystal drive output circuit 25, four different power voltage signals V0, V2, V3 and V5 are supplied. One of the voltage signals is selected for one segment electrode and the voltage signal is applied to the segment electrodes X1 to Xi in parallel. In addition, an alternating signal is supplied to the liquid crystal drive output circuit 25.

Figure 4:
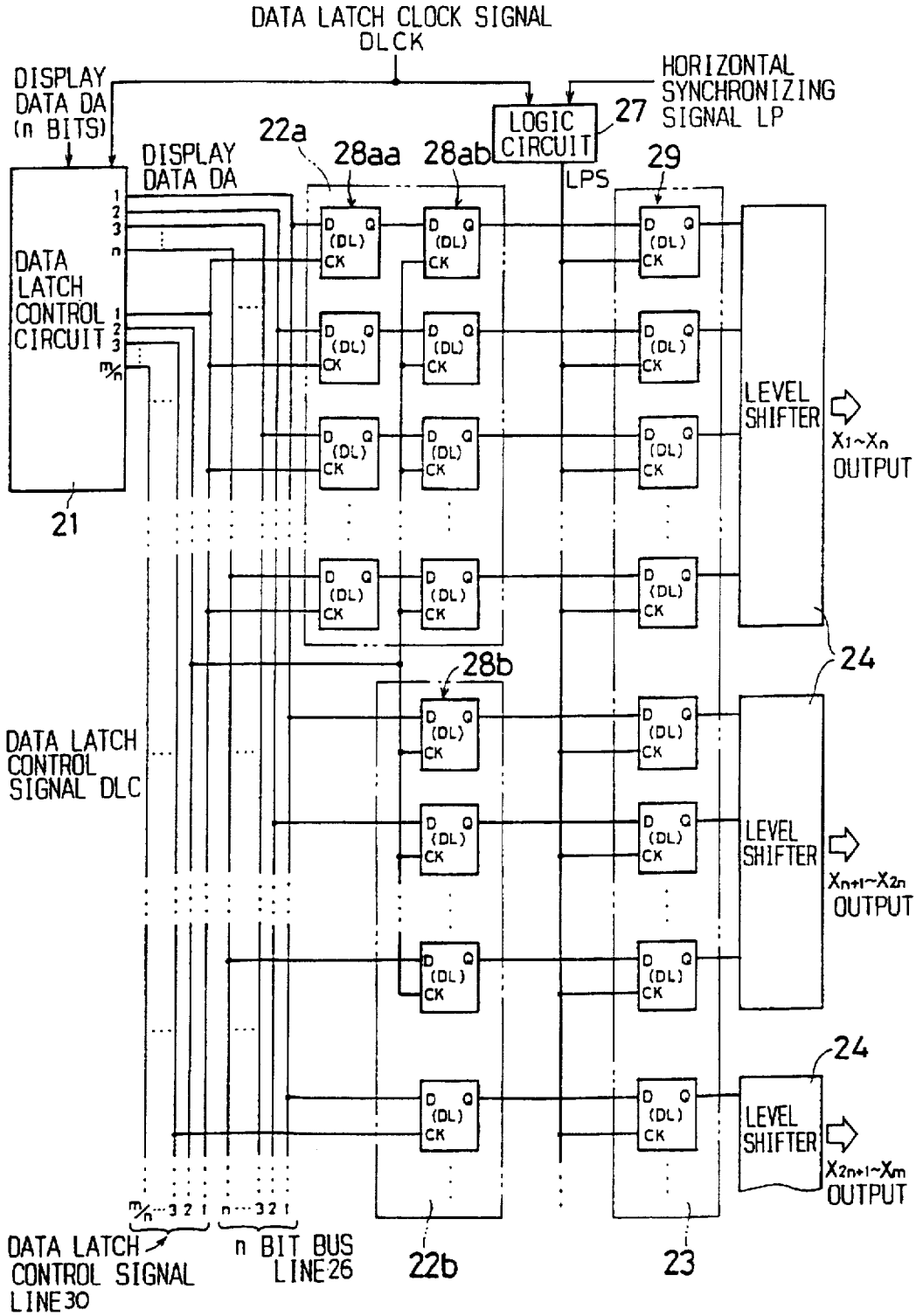
FIG. 4 is a circuit diagram showing the configuration of data latch circuits 22*a*, 22*b* and a line latch circuit 23.

FIG. 4 is a circuit diagram showing the configuration structures of the data latch circuits 22*a*, 22*b* and the line latch circuit 23. The data latch circuit 22*a* comprises n pieces of D latch circuits 28*aa* disposed in parallel and n pieces of D latch circuits 28*ab* disposed in parallel, the D latch circuits 28*aa* being connected to the D latch circuits 28*ab* in series. The D latch circuits 28*aa* are disposed as a first stage and the D latch circuits 28*ab* are disposed as a second stage. The data latch circuit 22*b* comprises (m–n) pieces of D latch circuits 28*b* which are connected in parallel.

The n-bit bus line 26 for connecting the data latch control circuit 21 to the data latch circuits 22*a*, 22*b* comprises n pieces of lines. The n pieces of lines are sequentially connected to the D terminals of n pieces of D latch circuits 28*aa* which form the first stage of the data latch circuit 22*a*. In addition, the n pieces of lines are also sequentially connected to the D terminals of (m–n) pieces of D latch circuits 28*b* of the data latch circuit 22*b*. The display data DA is supplied n bits at a time to the D latch circuits 28*aa*, 28*b* via the n-bit bus line 26.

m/n pieces of the data latch control signals DLC created on the basis of the data latch clock signal DLCK by the data latch control circuit 21 are supplied to the data latch circuits 22*a*, 22*b* via a data latch control signal line 30. The data latch control signal line 30 comprises m/n pieces of lines. The first line is connected to the CK terminals of the D latch circuits 28*aa* of the data latch circuits 22*a*, the second line is connected to the CK terminals of the D latch circuits 28*b* of the data latch circuit 22*b* so that the single line is connected to n pieces of the D latch circuits 28*b* in sequence. The second line is also connected to the CK terminals of n pieces of D latch circuits 28*ab* disposed at the second stage of the data latch circuit 22*a*. The Q terminals of the D latch circuits 28*aa* are connected to the corresponding D terminals of the D latch circuits 28*ab*.

The output signals from the Q terminals of the D latch circuits 28*ab* and the D latch circuits 28*b* are supplied to the D terminals of m pieces of D latch circuits 29 which form the line latch circuit 23. The D latch circuits 29 are arranged in parallel. The capture signal LPS created on the basis of the data latch clock signal DLCK and the horizontal synchronizing signal LP by the logic circuit 27 is inputted to the CK terminals of the plural D latch circuits 29 of the line latch circuit 23. The output signals from the Q terminals of the plural D latch circuits 29 are supplied to the level shifters 24.

Figure 5A:
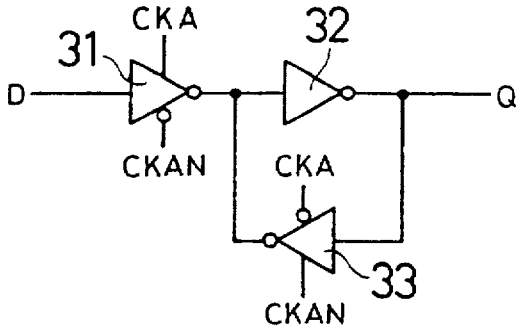
FIGS. 5A, 5B are circuit diagrams showing the construction of D latch circuits 28*aa*, 28*ab* and 28*b*.
Figure 5B:
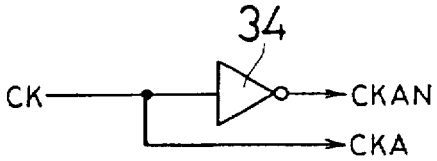

FIGS. 5A, 5B are circuit diagrams showing the configuration of the D latch circuits 28*aa*, 28*ab* and 28*b*. The D latch circuits 28*aa*, 28*ab* and 28*b* are all identical in structure. One D latch circuit comprises clocked inverters 31, 33 and inverters 32, 34. The input signal to the CK terminal is inverted by the inverter 34 to generate an inverted signal CKAN, and a noninverted signal of the input signal is also delivered as a signal CKA. The input signal from the D terminal is outputted from the Q terminal via the clocked inverters 31, 33 and the inverter 32.

When signal CKA is "H", the clocked inverter 31 and the inverter 32 are on (in operation) and the clocked inverter 33 is off. The output of the clocked inverter 33 is in the open condition. That is to say, the input signal to the D terminal is inverted by the clocked inverter 31 and further inverted by the inverter 32 and then delivered from the Q terminal. While signal CKA is "H", a signal, the level of which is as high as that of the input signal to the D terminal is outputted from the Q terminal.

On the other hand, when signal CKA is "L", the inverter 32 and the clocked inverter 33 are on and the clocked inverter 31 is off. The output of the clocked inverter 31 is in the open condition. That is to say, the data obtained at the fall of signal CKA is retained by the loop of the inverter 32 and the clocked inverter 33, and is outputted from the Q terminal.

Figure 6:
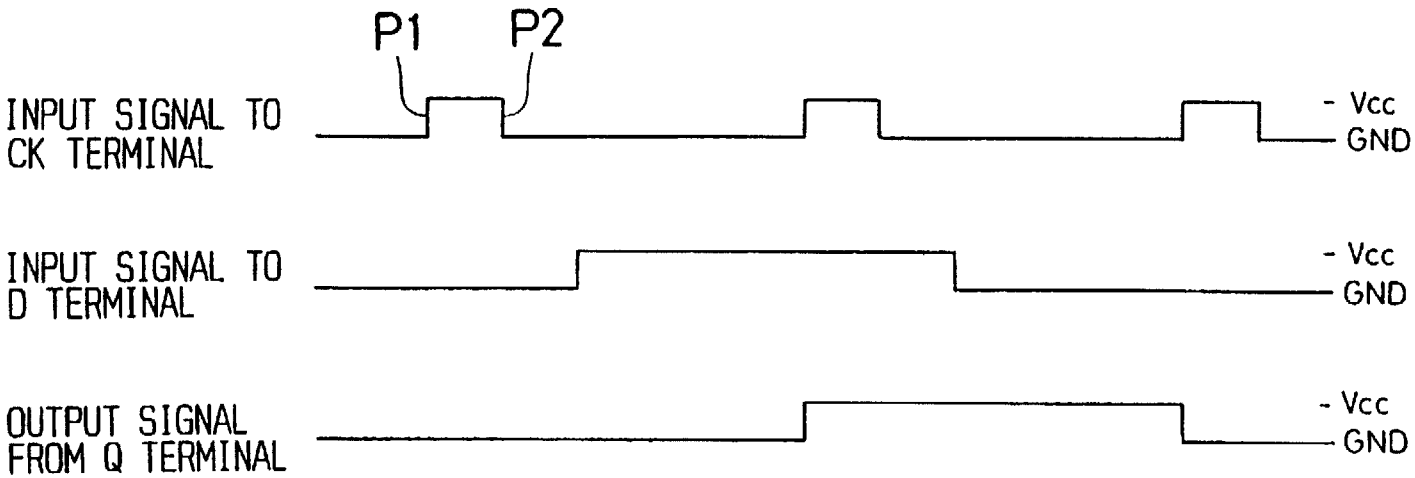
FIG. 6 is a timing chart showing the operation of the D latch circuit.

FIG. 6 is a timing chart showing the operation of the D latch circuit. At the rising timing P1 of the input signal to the CK terminal shown in FIG. 6, an output signal, the level of which is as high as that of the input signal to the D terminal is outputted from the Q terminal. During the period between the falling timing P2 of the input signal to the CK terminal and the next rising timing of the input signal to the CK terminal, the level of the input signal to the D terminal at the timing P2 is retained and the signal is outputted from the Q terminal. Accordingly, the output signal from the Q terminal is obtained as shown in FIG. 6.

Figure 7:
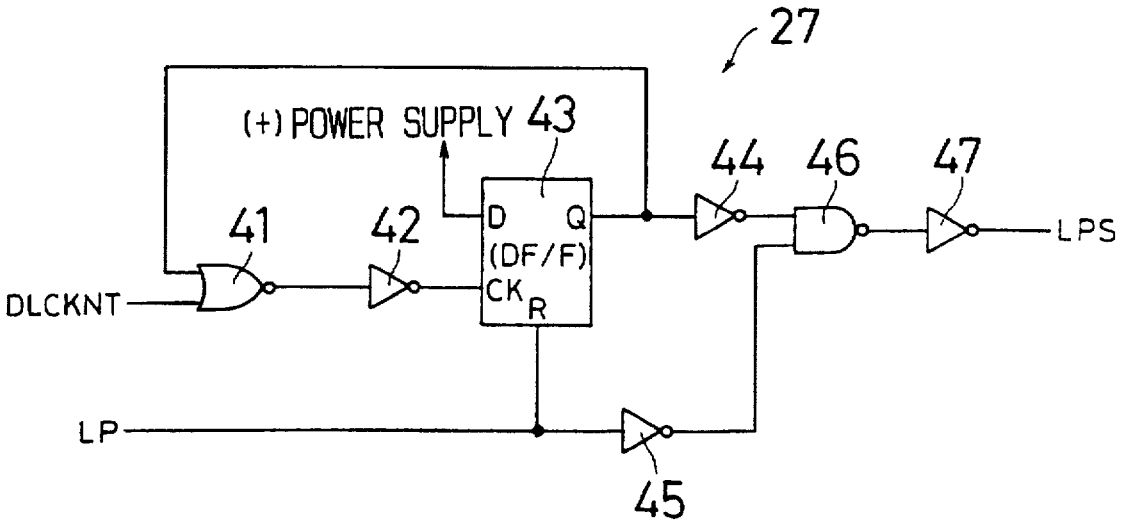
FIG. 7 is a circuit diagram showing the configuration of a logic circuit 27.

FIG. 7 is a circuit diagram showing the configuration of the logic circuit 27. The logic circuit 27 comprises a NOR circuit 41, inverters 42, 44, 45 and 47, a DFF circuit 43, and a NAND circuit 46. Signal DLCKNT, the inverted signal of the data latch clock signal DLCK, is supplied to one of the terminals of the NOR circuit 41, and the output signal from the NOR circuit 41 is inverted by the inverter 42 and supplied to the CK terminal of the DFF circuit 43. Power voltage having a predetermined constant level is applied to the D terminal of the DFF circuit 43. The output signal from the Q terminal of the DFF circuit 43 is supplied to the other terminal of the NOR circuit 41.

Furthermore, the output signal is inverted by the inverter 44 and supplied to one of the terminals of the NAND circuit 46. The horizontal synchronizing signal LP is supplied to the R terminal of the DFF circuit 43. Furthermore, signal LP is inverted by the inverter 45 and supplied to the other terminal of the NAND circuit 46. The output signal from the NAND circuit 46 is inverted by the inverter 47. The capture signal LPS is created in this way.

Logically, the inverter 42 can be eliminated by replacing the NOR circuit 41 with an OR circuit, and the inverter 47 can also be eliminated by replacing the NAND circuit 46 with an AND circuit.

Figure 8:
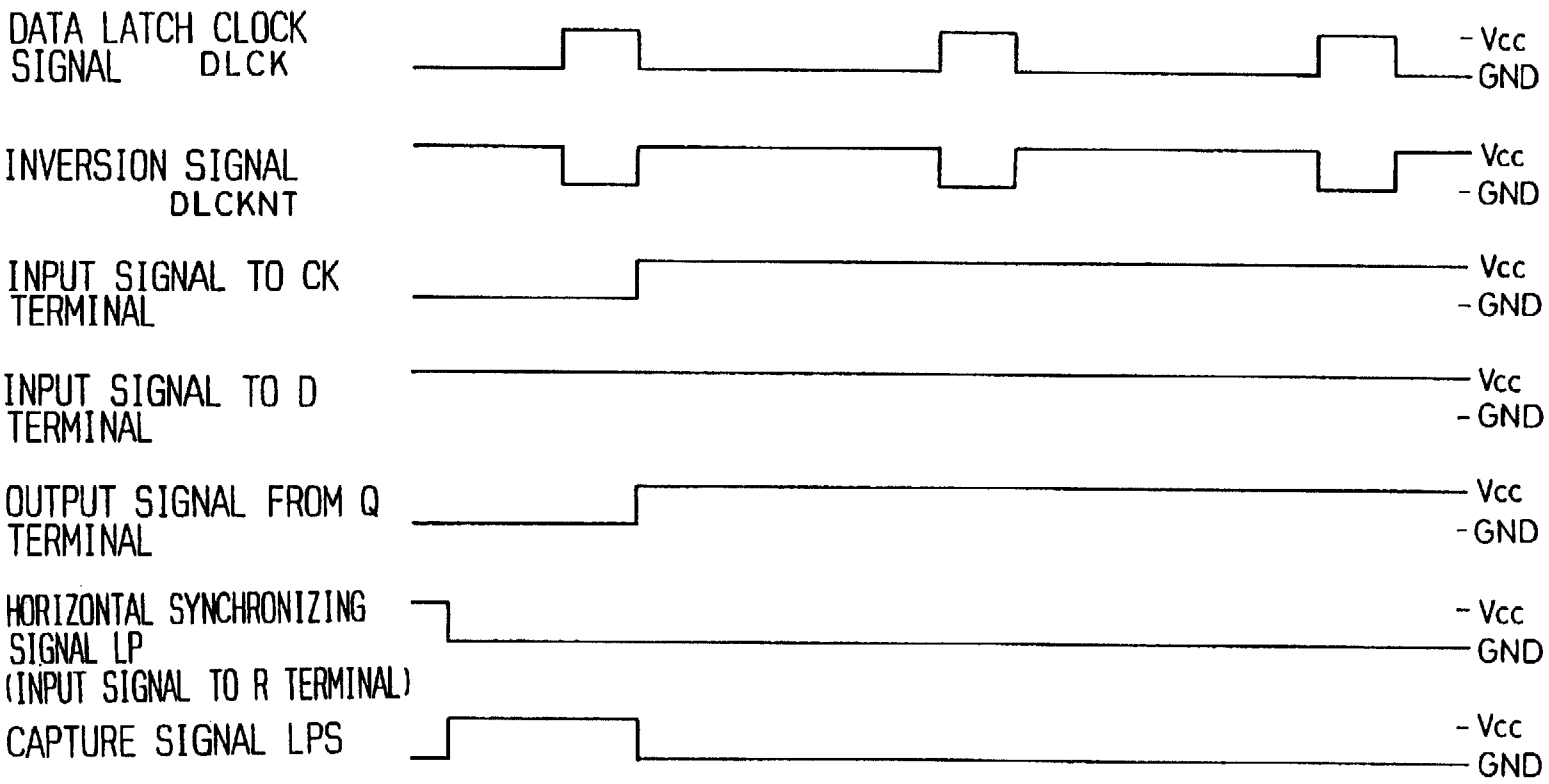
FIG. 8 is a timing chart showing the operation of the logic circuit 27.

FIG. 8 is a timing chart showing the operation of the logic circuit 27. The data latch clock signal DLCK is inverted to the inversion signal DLCKNT shown in FIG. 8, and the inversion signal is supplied to one of the terminals of the NOR circuit 41. A "H" level power voltage signal is always inputted to the D terminal of the DFF circuit 43 as shown in FIG. 8. When the horizontal synchronizing signal LP shown in FIG. 8 is inputted to the R terminal of the DFF circuit 43, the output signal from the Q terminal of the circuit 43 is at "L" level as shown in FIG. 8. This signal is supplied to the other terminal of the NOR circuit 41. The "L" level signal shown in FIG. 8 is inputted to the CK terminal of the DFF circuit 43. When the horizontal synchronizing signal LP becomes a "L" level, the capture signal LPS outputted from the logic circuit 27. This "H" level signal is retained until the becomes a "H" level signal from the Q terminal of the DFF circuit 43 turns "H" at the rising timing of the inverted signal DLCKNT. When the output signal from the Q terminal becomes a "H" level, the capture signal LPS becomes a "L" level.

FIG. 9 is a timing chart showing the operation of the data latch control circuit 21, the data latch circuits **22*a*, 22*b* and the line latch circuit 23 of the segment-side drive circuit 2. The data latch clock signal DLCK shown in FIG. 9 and outputted from the control circuit 5 is supplied to the data latch control circuit 21. The control circuit 21 creates the data latch control signals DLC1 to DLC (m/n) having timing values shifted by one period from one another, as shown in FIG. 9. The data latch control signal DLC is created by the shift register of the data latch control circuit 21. The data latch control signal DLC1 is supplied to the CK terminals of the D latch circuits 28*aa* of the data latch circuit 22*a* via the first line of the data latch control signal line 30. By this operation, the display data DA supplied to the first line of the n-bit bus line 26 is captured from the D terminals of the D latch circuits 28*aa*. The D latch circuits 28*aa*** capture the display data DA at the rising timing of the data latch control signal DLC1.

The data latch control signal DLC2 shown in FIG. 9 is supplied to the CK terminals of the D latch circuits **28*ab* at the second stage of the data latch circuit 22*a* and the CK terminals of the n-bit amounts of the D latch circuits 28*b* of the data latch circuit 22*b* via the second line of the data latch control signal line 30. By this operation, the display data DA captured in the D latch circuits 28*aa* at the first stage of the data latch circuit 22*a* is captured in the D latch circuits 28*ab* at the second stage of the D latch circuit 28*ab*, and the second n-bit amounts of the display data DA is captured in the n-bit amounts of the D latch circuits 28*b* of the data latch circuit 22*b* via the second line of the n-bit bus line 26. In other words, the display data DA to be captured in the D latch circuits 28*ab* and the D latch circuits 28*b* is captured at the timing shown in FIG. 9. Hereinafter, the display data DA is captured in sequence at the timing shown in FIG. 9** until the data latch control signal DLC (m/n) is supplied.

After the display data DA for one scanning electrode is delivered, the capture signal LPS shown in FIG. 9 rises at the falling timing of the horizontal synchronizing signal LP shown in FIG. 9. At this timing, the display data DA for one scanning electrode captured in the D latch circuits **28*ab*, 28*b* is loaded in unison to the D latch circuit 29 of the line latch circuit 23 as shown in the line latch output data in FIG. 9. The capture signal LPS is delivered continuously until the first falling timing of the data latch clock signal DLCK, corresponding to the next scanning electrode, is reached as shown in FIG. 9**.

In this way, the display data DA for one scanning electrode is delivered to the liquid crystal panel 1. When the display data DA for all the scanning electrodes is delivered, a screen of display is performed.

FIG. 10 is a timing chart showing the output operation of the display data DA of a display device in accordance with a conventional embodiment. FIG. 11 is a timing chart showing the output operation of the display data DA of the liquid crystal display device 17 in accordance with the present embodiment of the invention. In the display device in accordance with the conventional embodiment, the data latch control signal DLC (m/n−1), DLC (m/n), DLC1 shown in FIG. 10 are created from the data latch clock signal DLCK shown in FIG. 10. The display data DA is captured in the data latch circuit at the rising timing of the data latch control signal DLC. In addition, the capture signal LPS shown in FIG. 10 is created from the horizontal synchronizing signal LP shown in FIG. 10. The display data DA is captured in the line latch circuit from the data latch circuit at the falling timing of the capture signal LPS.

To capture the display data DA in the line latch circuit from the data latch circuit at this time, the display data DA must be loaded to the line latch circuit during the period t1 between the rise of the m/nth data latch control signal DLC shown in FIG. 10 and the rise of the capture signal LPS shown in FIG. 10. At this time, the m/nth data latch control signal DLC is delayed as shown in FIG. 10. When the capture signal LPS is delayed as shown in FIG. 10, the period t1 is shortened. In case the data latch control signal DLC and the capture signal LPS are delayed by the period t1 or more, the period of capture in the line latch circuit from the data latch circuit ends with the condition that the m/nth display data DA is not captured in the data latch circuit. In this way, in the conventional art, the period of the capture signal LPS is relatively short. When the display panel is intended for a larger, finer and colored device, a display data DA capture error occurs, thereby deteriorating the quality of display.

In the display device 17 in accordance with the present embodiment, the data latch control signals DLC (m/n−1), DLC (m/n), DLC1 and DLC2 shown in FIG. 11 are also created from the data latch clock signal DLCK shown in FIG. 11. By these signals, the display data DA is captured in the data latch circuits 22*a*, 22*b*. In addition, the capture signal LPS shown in FIG. 11 is created on the basis of the data latch clock signal DLCK shown in FIG. 11 and the horizontal synchronizing signal LP shown in FIG. 11. By this signal, the display data DA is captured in the line latch circuit 23 from the data latch circuits 22*a*, 22*b*. In the present embodiment, the data latch control signal DLC and the capture signal LPS are also delayed, as shown in FIG. 11.

However, in the present embodiment, the capture signal LPS is created on the basis of the data latch clock signal DLCK and the horizontal synchronizing signal LP. The period of the signal is between the fall of the horizontal synchronizing signal LP and the fall of the first data latch clock signal DLCK for the next scanning electrode. This period is longer than that of the conventional art. Therefore, the m/nth n-bit display data DA can be captured securely in the data latch circuit 22*b*, and the display data DA can be captured securely in the line latch circuit 23. Therefore, an error of display data DA capture does not occur and the quality of display is not deteriorated.

Furthermore, the display data DA captured by the data latch clock signal DLCK for the next scanning electrode is captured in the D latch circuits 28*aa* at the first stage of the data latch circuit 22*a*. Therefore, the display data DA for the next scanning electrode can also be captured securely.

Moreover, in the embodiment, the data latch circuit 22*a* comprises the D latch circuits 28*aa* and 28*ab*, the data latch circuit 22*b* comprises the D latch circuits 28*b*, and the line latch circuit 23 comprises D latch circuits 29. Since the number of elements constituting the D latch circuits is relatively small, the size of the IC chip can be made smaller, and when the IC chip is built in the liquid crystal panel 1, the peripheral portion of the panel occupied by the drive circuit irrelevant to actual display can be made more compact. Furthermore, since the IC chip is small, the cost of its production can be reduced.

When the effect of miniaturization of the D latch circuits is not necessary, the data latch circuits 22*a*, 22*b* can be formed by using DFF circuits. With the DFF circuits, the display data DA can be captured securely, excellent display quality can be obtained and high speed drive is possible.

FIG. 12 is a circuit diagram showing the data latch circuits 22*a*, 22*b* and the line latch circuit 23 of a liquid crystal display device in accordance with another embodiment of the invention. Unlike the data latch circuit 22*a* of the foregoing embodiment, the data latch circuit 22*a* of this embodiment is composed of DFF circuits 50*a*, 50*b*. The data latch circuit 22*b* is composed of D latch circuits 28*b*. The data latch control signal DLC is inverted by inverters 51, 52 and supplied to the circuit 28*b*.

FIG. 13 is a circuit diagram showing the configuration of the DFF circuits 50*a*, 50*b*. The DFF circuits 50*a*, 50*b* have the same structure, and each circuit comprises clocked inverters 53, 55, 56, 58 and inverters 54, 57. The inverted signal CKAN and the noninverted signal CKA used as the input signals to the CK terminal are inputted to the clocked inverters 53, 55, 56, 58.

When signal CKA is "H", the clocked inverters 53, 58 are off, and data is retained between the clocked inverter 55 and the inverter 54. That is to say, a signal having the same level as that of the input signal supplied to the D terminal at the rise of signal CKA is outputted to the Q terminal, and the level of the output signal is retained until the rise of the next CKA signal.

On the other hand, when signal CKA is "L", the clocked inverters 55, 56 are off, and data is retained between the clocked inverter 58 and the inverter 57. That is to say, the level of the input signal supplied to the D terminal at the fall of signal CKA is retained and the signal is outputted from the Q terminal.

FIG. 14 is a timing chart showing the operation of the DFF circuit. When both the input signal to the D terminal and the output signal from the Q terminal are at a "L" level, the output signal from the Q terminal remains "L" at the falling timing P3 of the input signal to the CK terminal, as shown in FIG. 14. When the input signal from the D terminal is at a "H" level, the output signal from the Q terminal remains "H" at the rising timing of the next input signal to the CK terminal. While the input signal of the D terminal is at a "H" level, the output signal from the Q terminal remains "H" regardless of the level of the input signal to the CK terminal. When the input signal to the D terminal becomes a "L" level again, the output signal from the Q terminal becomes "L" at the rising timing of the next input signal to the CK terminal.

FIG. 15 is a timing chart showing the output operation of the display data DA of the display device in accordance with the embodiment. The embodiment is the same as the embodiment described before, except that the logic level of the data latch control signal DLC is opposite to that of the data latch control signal DLC of the embodiment described before. In other words, the data latch control signals DLC (m/n−1), DLC (m/n), DLC1 and DLC2 shown in FIG. 15 are created from the data latch clock signal DLCK shown in FIG. 15. By these signals, the display data DA is captured in the data latch circuits 22*a*, 22*b*. In addition, the capture signal LPS shown in FIG. 15 is created on the basis of the data latch clock signal DLCK shown in FIG. 15 and the horizontal synchronizing signal LP shown in FIG. 15. The capture signal LPS is delivered during the period between the fall of the horizontal synchronizing signal LP and the fall of the data latch clock signal DLCK for the next scanning electrode, that is, the rise of the data latch control signal DLC1. During the period, the display data DA is captured in the line latch circuit 23 from the data latch circuits 22*a*, 22*b*.

In the embodiment, the capture signal LPS is delivered during the period between the fall of the horizontal synchronizing signal LP and the fall of the data latch clock signal DLCK for the next scanning electrode. Since this period is relatively long, the display data DA can be captured securely in the data latch circuits 22*a*, 22*b* and can also be captured in the line latch circuit 23, thereby affording excellent display quality.

FIG. 16 is a block diagram showing the configuration of the segment-side drive circuit 2 of a liquid crystal display device in accordance with still another embodiment of the invention. The segment-side drive circuit 2 in accordance with this embodiment comprises the data latch control circuit 21, data latch circuits 22*c* to 22*e*, line latch circuits 23*a* to 23*c*, level shifter 24, liquid crystal drive output circuit 25 and logic circuit 27. The same circuits as those used for the segment-side drive circuit 2 of the embodiment described before are designated by the same reference numerals, and these circuits are not explained here.

The data latch control circuit 21 is connected to the data latch circuits 22*c* to 22*e* via the n-bit bus line 26. In addition, the data latch control signal DLC created by the data latch control circuit 21 is supplied to the data latch circuits 22*c* to 22*e*.

Output signals SHL, NSHL from a data latch direction selection terminal are supplied to the data latch control circuit 21 and the data latch circuits 22*c*, 22*d*. On the basis of the signals, the data latch control circuit 21 determines the sequence of the lines of the n-bit bus line 26 to which the display data DA is supplied, and also determines the sequence of the lines to which the data latch control signal DLC is outputted. Furthermore, the data latch circuits 22*c*, 22*d* select the outputs from the D latch circuits in the circuits 22*c*, 22*d* in accordance with signals SHL, NSHL as described later.

The data latch circuits 22*c* to 22*e* capture the display data DA in accordance with the data latch control signal DLC on the basis of the data latch clock signal DLCK and supplies the data to the line latch circuits 23*a* to 23*c*. The line latch circuits 23*a* to 23*c* capture the display data DA latched in the data latch circuits 22*c* to 22*e* in accordance with the capture signal LPS created on the basis of the data latch clock signal DLCK and the horizontal synchronizing signal LP.

FIG. 17 is a circuit diagram showing the data latch circuits 22*c*, 22*e* and the line latch circuits 23*a*, 23*c* of the segment-side drive circuit 2 of the embodiment. Since the data latch circuit 22*d* is the same as the data latch circuit 22*c* in structure, and the line latch circuit 23*b* is the same as the line latch circuit 23*a* in configuration, these circuits are not explained here.

Like the above-mentioned data latch circuit 22*a*, the data latch circuit 22*c* comprises n pieces of D latch circuits 28*aa* at the first stage, n pieces of D latch circuits 28*ab* at the second stage and further n pieces of clocked inverters 61, 62. The output signals from the Q terminals of the D latch circuits 28*aa* at the first stage are supplied to the D terminals of the D latch circuits 28*ab* at the second stage as well as are supplied to the clocked inverters 61. The output signals from the Q terminals of the D latch circuits 28*ab* at the second stage are supplied to the clocked inverters 62. In addition, signal SHL is supplied to the clocked inverters 62, the inverted signal of signal SHL is supplied to the clocked inverters 61, signal NSHL is supplied to the clocked inverters 61 and the inverted signal of signal NSHL is supplied to the clocked inverters 62. The clocked inverters 61, 62 invert the logic levels of the display data DA on the basis of signals SHL, NSHL.

Signals SHL, NSHL represent the sequence of scanning electrodes to which the display data DA is supplied. For example, signal SHL represents that the display data DA is supplied in a direction from the electrode X1 to the electrode Xi, and signal NSHL represents that the display data DA is supplied in a direction from the electrode Xi to the electrode X1. When a "H" level signal is supplied to the clocked inverters 61, a "L" level signal is supplied to the clocked inverters 62, and when a "L" level signal is supplied to the clocked inverters 61, a "H" level signal is supplied to the clocked inverters 62.

When the display data DA is supplied in sequence in the direction from the electrode X1 to the electrode Xi, signals SHL, NSHL controls the clocked inverters 61, 62 so that the data latch circuit 22*c* is formed to have two stages of D latch circuits and that the data latch circuit 22*d* is formed to have one stage of D latch circuits. On the other hand, when the display data DA is supplied in sequence in the direction from the electrode Xi to the electrode X1, signals SHL, NSHL controls the clocked inverters 61, 62 so that the data latch circuit 22*c* is formed to have one stage of D latch circuits and that the data latch circuit 22*d* is formed to have two stages of D latch circuits.

More specifically, when the data latch circuit 22*c* is formed to have two stages, the "H" level output signals from the Q terminals of the D latch circuits 28*aa* are inverted by the clocked inverters 61 and become "L". The output signals from the Q terminals of the D latch circuits 28*ab* are not inverted by the clocked inverters 62, but outputted at the unchanged level. Therefore, signal SHL supplied to the clocked inverters 61 is used to make the clocked inverters 61 function as inverters, and signal NSHL supplied to the clocked inverters 62 is used not to make the clocked inverters 62 function as inverters. Signals SHL, NSHL supplied to the clocked inverters are inverted not to invert the output signals from the D latch circuits 28*aa* but to invert the output signals from the D latch circuits 28*ab* so that the data latch circuit 22*d* is formed to have one stage.

On the other hand, when the data latch circuit 22*c* is formed to have one stage, the "H" level output signals from the Q terminals of the D latch circuits 28*aa* are not inverted by the clocked inverters 61 and are delivered at the unchanged level. The output signals from the Q terminals of the D latch circuits 28*ab* are inverted by the clocked inverters 62 and delivered. Therefore, signal SHL supplied to the clocked inverters 61 is used not to make the clocked inverters 61 function as inverters, and signal NSHL supplied to the clocked inverters 62 is used to make the clocked inverters 62 function as inverters. Since signals SHL, NSHL supplied to the clocked inverters of the data latch circuit 22*d* are inverted, the output signals from the D latch circuits 28*aa* are inverted and the output signals from the D latch circuit 28*ab* are not inverted. Therefore, the data latch circuit 22*d* is formed to have two stages.

The data latch circuit 22*e* disposed between the data latch circuits 22*c* and 22*d* comprises (m−2n) pieces of D latch circuits 28*b*.

Signals SHL, NSHL are also supplied to the data latch control circuit 21. By these signals, the sequence of lines from which the display data DA and the data latch control signal DLC are supplied is selected. More specifically, the signals are used to determine whether the display data DA is supplied in the direction from the first line to the nth line or in the direction from the nth line to the first line of the n-bit bus line. In addition, the signals are also used to determine whether the data latch control signal DLC is supplied in the direction from the first line to the m/nth line or in the direction from the m/nth line to the first line of the data latch control signal line.

The line latch circuit 23*a* comprises n pieces of D latch circuits 29*a* and n pieces of inverters 63, and the line latch circuit 23c comprises (m–2n) pieces of D latch circuits 29c. The output signals from the Q terminals of the D latch circuits 28aa, 28ab of the data latch circuit 22c are supplied to the D terminals of the D latch circuits 29a of the line latch circuit 23a via the clocked inverters 61, 62. Furthermore, the output signals from the Q terminals of the D latch circuits 28b of the data latch circuit 22e are supplied to the D terminals of the D latch circuits 29c of the line latch circuit 23c. The capture signal LPS is supplied to the CK terminals of the D latch circuits 29a, 29c of the line latch circuits 23a, 23c. The output signals from the Q terminals of the D latch circuits 29a are supplied to the level shifter 24 via the inverters 63, and the output signals from the Q terminals of the D latch circuits 29c are supplied directly to the level shifters 24.

The single segment-side drive circuit 2 can thus deliver the display data DA in two directions by forming the n-bit D latch circuits on both end sides of the D latch circuits of the data latch circuits 22c to 22e arranged in parallel in two stages and by controlling the clocked inverters 61, 62 so that either of the n-bit D latch circuits functions in two stages. More specifically, the sequence of delivering the display data DA in the direction from the electrode X1 to electrode Xi or in the direction from the electrode Xi to electrode X1 can be determined easily as desired by of the user. Even in this case, since the capture signal LPS is provided in a relatively long period, the display data DA can be captured securely in the data latch circuits 22c to 22e and the line latch circuits 23a to 23c. Therefore, high speed drive is made possible and excellent display quality can be obtained.

FIG. 18 is a circuit diagram showing the data latch circuits 22c, 22e and the line latch circuits 23a, 23c of the segment-side drive circuit 2 wherein DFF circuits 50a, 50b are used instead of the D latch circuits 28aa, 28ab shown in FIG. 17 in accordance with still another embodiment of the invention. The configuration of this circuit is the same as that of the circuit shown in FIG. 17 except that the data latch control signal DLC to be supplied to the CK terminals of the D latch circuits 28b of the data latch circuit 22e is supplied via inverters 51, 52.

Even in this configuration, the display data DA can be delivered in two directions as described before. The display data DA can be captured securely in the data latch circuits 22c to 22e and the line latch circuits 23a to 23c. Therefore, high speed drive is possible and excellent display quality can be obtained.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A display device comprising:

a display panel wherein a plurality of segment electrodes disposed in parallel with one another are arranged orthogonal to a plurality of scanning electrodes disposed in parallel with one another, the intersections of electrodes are used as pixels, and data signals for determining display conditions are supplied from the segment electrodes to the pixels on the scanning electrodes selected by selection signals sequentially supplied to the scanning electrodes;

a signal output circuit for delivering a clock signal which is to be used as the reference of signal output timings, the data signals, the selection signals, a horizontal synchronizing signal to be delivered each time the delivery of the data signal for one scanning electrode ends, and a vertical synchronizing signal to be delivered each time the delivery of the data signals for all the scanning electrodes ends;

a segment-side drive circuit for retaining the data signal for one scanning electrode and for supplying the retained data signal to the segment electrodes; and a common-side drive circuit for sequentially supplying a selection signal to the scanning electrodes, wherein the data signals are delivered in parallel to n (n is an integer of 1 or greater) pieces of segment electrodes within one period of the clock signal, the parallel signals are delivered x/n times (x is the total of segment electrodes; when x is not an integer multiple of n, a decimal fraction thereof is rounded up) to supply data signals for one scanning electrode, and the segment-side drive circuit includes:

a data latch control circuit for outputting the first to m/nth (m is an integer multiple of n and the number of segment electrodes to which data signals to be supplied at one time are supplied by the segment-side drive circuit) latch control signals, the logic level of which is inverted while data signals for n pieces of segment electrodes are supplied and the logic level inversion timing values of which are shifted from one another by one period of the clock signal;

a data latch circuit for capturing data signals in accordance with the latch control signal;

a capture signal output circuit for outputting a capture signal for capturing data during the period between the termination of the delivery of the horizontal synchronizing signal and the termination of the delivery of the first clock signal for the next scanning electrode in accordance with the horizontal synchronizing signal and the clock signal;

a line latch circuit for retaining data signals for one scanning electrode retained in the data latch circuit while the capture signal is outputted; and a data output circuit for outputting data signals for one scanning electrode retained in the line latch circuit to the segment electrodes of the display panel, wherein the data latch circuit includes:

a first latch circuit portion comprising n pieces of latch circuits disposed in parallel with one another at a first stage thereof and n pieces of other latch circuits disposed in parallel with one another at a second stage thereof, the latch circuits at the first stage being connected to the latch circuits at the second stage in series, respectively; and a second latch circuit portion comprising (m–n) pieces of latch circuits disposed in parallel with one another and connected to the latch circuits of the first latch circuit portion in parallel so that the first and second latch circuit portions can be used as one latch circuit group of n pieces of latch circuits, wherein among the data signals for one scanning electrode, a data signal to be delivered the first time is retained in the latch circuits at the first stage of the first latch circuit portion in accordance with the first latch control signal;

the data signal retained at the first stage of the first latch circuit portion is retained in the latch circuits at the second stage, while the data signal to be delivered the second time is retained in the latch circuit group of the second latch circuit portion in accordance with the second latch control signal; and the remaining data signals of the data signals for one scanning electrode are retained sequentially in the latch circuit group of the second latch circuit portion in accordance with the third to m/nth latch control signals.

2. The display device according to claim 1, wherein the latch circuits constituting the data latch circuit and the line latch circuit are D latch circuits.

3. The display device according to claim 1, wherein the latch circuits constituting the data latch circuit are D flip-flop circuits, and the latch circuits constituting the line latch circuit are D latch circuits.

4. The display device according to claim 1, wherein the latch circuits constituting the first latch circuit portion of the data latch circuit are D flip-flop circuits, and the latch circuits constituting the second latch circuit portion of the data latch circuit are D latch circuits.

5. The display device according to claim 1, wherein the latch circuits constituting the first latch circuit portion of the data latch circuit are D latch circuits, and the latch circuits constituting the second latch circuit portion of the data latch circuit are D flip-flop circuits.

6. The display device according to claim 1, wherein the capture signal output circuit comprises:

a D flip-flop circuit, supplied with a predetermined power voltage at the data input terminal D and with a horizontal synchronizing signal at the reset terminal R, outputs an output signal, the level of which is the same as that of the input signal, to the data input terminal D from the output terminal Q in accordance with the input signal to the clock terminal CK, retains the output signal from the output terminal Q at the level of the input signal to the data input terminal D as long as the level of the input signal to the data input terminal D remains unchanged, and resets the output signal from the output terminal Q in accordance with the input signal to the reset terminal R;

a NOR circuit, one of the terminals of which is supplied with the output signal from the output terminal Q of the D flip-flop circuit and the other terminal of which is supplied with a clock signal;

a first inversion circuit for inverting the output signal from the NOR circuit and for supplying the inverted signal to the clock terminal CK of the D flip-flop circuit;

a second inversion circuit for inverting the output signal from the output terminal Q of the D flip-flop circuit;

a third inversion circuit for inverting the horizontal synchronizing signal;

a NAND circuit, one of the terminals of which is supplied with the output signal from the second inversion circuit and the other terminal of which is supplied with the output signal from the third inversion circuit; and a fourth inversion circuit for inverting the output signal from the NAND circuit, wherein the output signal from the NAND circuit is used as the capture signal.

7. A display device comprising:

a display panel wherein a plurality of segment electrodes disposed in parallel with one another are arranged orthogonal to a plurality of scanning electrodes disposed in parallel with one another, the intersections of electrodes are used as pixels, and data signals for determining display conditions are supplied from the segment electrodes to the pixels on the scanning electrodes selected by selection signals sequentially supplied to the scanning electrodes;

a signal output circuit for delivering a clock signal which is to be used as the reference of signal output timing, the data signals, the selection signals, a horizontal synchronizing signal to be delivered each time the delivery of the data signal for one scanning electrode ends, and a vertical synchronizing signal to be delivered each time the delivery of the data signals for all the scanning electrodes ends;

a segment-side drive circuit for retaining the data signal for one scanning electrode and for supplying the retained data signal to the segment electrodes; and a common-side drive circuit for sequentially supplying a selection signal to the scanning electrodes, wherein the data signals are delivered in parallel to n (n is an integer of 1 or greater) pieces of segment electrodes within one period of the clock signal, and the parallel signals are delivered x/n times (x is the total of segment electrodes; when x is not an integer multiple of n, a decimal fraction thereof is rounded up) to supply data signals for one scanning electrode, and the segment-side drive circuit includes:

a data latch control circuit for outputting the first to m/nth (m is an integer multiple of n and the number of segment electrodes to which data signals to be supplied at one time are supplied by the segment-side drive circuit) latch control signals, the logic level of which is inverted while data signals for n pieces of segment electrodes are supplied and the logic level inversion timing values of which are shifted from one another by one period of the clock signal;

a data latch circuit for capturing data signals in accordance with the latch control signal;

a capture signal output circuit for outputting a capture signal for capturing data during the period between the termination of the delivery of the horizontal synchronizing signal and the termination of the delivery of the first clock signal for the next scanning electrode in accordance with the horizontal synchronizing signal and the clock signal;

a line latch circuit for retaining data signals for one scanning electrode retained in the data latch circuit while the capture signal is outputted; and a data output circuit for outputting data signals for one scanning electrode retained in the line latch circuit to the segment electrodes of the display panel, wherein the data latch circuit includes:

two first latch circuit portions, each comprising n pieces of latch circuits disposed in parallel with one another at a first stage thereof and n pieces of other latch circuits disposed in parallel with one another at a second stage thereof, the latch circuits at the first stage being connected to the latch circuits at the second stage in series, respectively;

a second latch circuit portion comprising (m–2n) pieces of latch circuits disposed in parallel with one another between the two first latch circuit portions and connected to the latch circuits of the first latch circuit portions in parallel so that the first and second latch circuit portions can be used as one latch circuit group of n pieces of latch circuits; and a switching circuit for disabling the output of the latch circuits at the first stage and for enabling the output of the latch circuits at the second stage of one of the two first latch circuit portions, and for enabling the output of the latch circuits at the first stage and for disabling the output of the latch circuits at the second stage of the other first latch circuit portion, or for enabling the output of the latch circuits at the first stage and for disabling the output of the latch circuits at the second stage of one of the two first latch circuit portions, and for disabling the outputs of the latch circuits at the first stage and for enabling the outputs of the latch circuits at the second stage of the other first latch circuit portion in accordance with the sequence of data signals to be supplied, wherein among the data signals for one scanning electrode, a data signal to be delivered the first time is retained in the latch circuits at the first stage of the first latch circuit portion, the latch circuits at the first stage of which are disabled, in accordance with the first latch control signal;

the data signal retained in the latch circuits at the first stage of one of the first latch circuit portion is retained in the latch circuits at the second stage, while the data signal to be delivered the second time is retained in the latch circuits of the second latch circuit portion in accordance with the second latch control signal; and the remaining data signals of the data signals for one scanning electrode are retained sequentially in the latch circuits of the second latch circuit portion in accordance with the third to (m/n-1)th latch control signals, and retained sequentially in the latch circuits at the first stage of the other first latch circuit portion, the outputs of the latch circuits of the first stage of which is enabled, in accordance with a m/nth latch control signal.

8. The display device according to claim 7, wherein the latch circuits constituting the data latch circuit and the line latch circuit are D latch circuits.

9. The display device according to claim 7, wherein the latch circuits constituting the data latch circuit are D flip-flop circuits, and the latch circuits constituting the line latch circuit are D latch circuits.

10. The display device according to claim 7, wherein the latch circuits constituting the first latch circuit portion of the data latch circuit are D flip-flop circuits, and the latch circuits constituting the second latch circuit portion of the data latch circuit are D latch circuits.

11. The display device according to claim 7, wherein the latch circuits constituting the first latch circuit portion of the data latch circuit are D latch circuits, and the latch circuits constituting the second latch circuit portion of the data latch circuit are D flip-flop circuits.

12. The display device according to claim 7, wherein the capture signal output circuit comprises:

a D flip-flop circuit, supplied with a predetermined power voltage at the data input terminal D and with a horizontal synchronizing signal at the reset terminal R, outputs an output signal, the level of which is the same as that of the input signal, to the data input terminal D from the output terminal Q in accordance with the input signal to the clock terminal CK, retains the output signal from the output terminal Q at the level of the input signal to the data input terminal D as long as the level of the input signal to the data input terminal D remains unchanged, and resets the output signal from the output terminal Q in accordance with the input signal to the reset terminal R;

a NOR circuit, one of the terminals of which is supplied with the output signal from the output terminal Q of the D flip-flop circuit and the other terminal of which is supplied with a clock signal;

a first inversion circuit for inverting the output signal from the NOR circuit and for supplying the inverted signal to the clock terminal CK of the D flip-flop circuit;

a second inversion circuit for inverting the output signal from the output terminal Q of the D flip-flop circuit;

a third inversion circuit for inverting the horizontal synchronizing signal;

a NAND circuit, one of the terminals of which is supplied with the output signal from the second inversion circuit and the other terminal of which is supplied with the output signal from the third inversion circuit; and a fourth inversion circuit for inverting the output signal from the NAND circuit, wherein the output signal from the NAND circuit is used as the capture signal.

* * * * *